US008040311B2

(12) United States Patent
Hudson et al.

(10) Patent No.: US 8,040,311 B2
(45) Date of Patent: Oct. 18, 2011

(54) SIMPLIFIED PIXEL CELL CAPABLE OF MODULATING A FULL RANGE OF BRIGHTNESS

(75) Inventors: Edwin Lyle Hudson, Elk Grove, CA (US); David Charles McDonald, Longmont, CO (US)

(73) Assignee: Jasper Display Corp., Hsinchu (TW)

( * ) Notice: Subject to any disclaimer, the term of this patent is extended or adjusted under 35 U.S.C. 154(b) by 906 days.

(21) Appl. No.: 11/906,216

(22) Filed: Oct. 1, 2007

(65) Prior Publication Data

US 2008/0088613 A1 Apr. 17, 2008

Related U.S. Application Data

(63) Continuation-in-part of application No. 10/413,649, filed on Apr. 15, 2003, now Pat. No. 7,443,374, and a continuation-in-part of application No. 10/329,645, filed on Dec. 26, 2002, now Pat. No. 7,468,717.

(60) Provisional application No. 60/848,426, filed on Sep. 29, 2006, provisional application No. 60/849,147, filed on Oct. 2, 2006, provisional application No. 60/849,566, filed on Oct. 5, 2006.

(51) Int. Cl.
*G09G 3/36* (2006.01)

(52) U.S. Cl. ..... 345/98; 345/90

(58) Field of Classification Search ..... 345/87, 345/90, 92, 98

See application file for complete search history.

(56) References Cited

U.S. PATENT DOCUMENTS

| | | | | |
|---|---|---|---|---|
| 5,157,387 | A * | 10/1992 | Momose et al. | 345/94 |
| 6,262,703 | B1 * | 7/2001 | Perner | 345/90 |
| 6,285,360 | B1 * | 9/2001 | Li | 345/204 |
| 7,187,355 | B2 * | 3/2007 | Tam et al. | 345/98 |
| 7,468,717 | B2 * | 12/2008 | Hudson | 345/98 |

* cited by examiner

*Primary Examiner* — Richard Hjerpe
*Assistant Examiner* — Alecia D English
(74) *Attorney, Agent, or Firm* — Kusner & Jaffe

(57) ABSTRACT

A simplified pixel display includes a plurality of pixel electrodes, a plurality of storage elements, a single arbitrary voltage supply terminal, a second voltage supply terminal which may be either of the rail voltages of the display, a common electrode, and a plurality of externally controlled switches each selectively coupling an associated one of the pixel electrodes with one of the arbitrary voltage supply terminal and the second voltage supply terminal responsive to a value of a data bit stored in an associated one of said storage elements and to the state of the external control signal supplied to the switch.

18 Claims, 31 Drawing Sheets

| | Truth table | | | node voltages | | | L.C. voltages |
|---|---|---|---|---|---|---|---|
| | A | ck | B | B | D | C | |
| "OFF" | 0 | 0 | 1 | $V_B$ | 0 | $(V_B-V_D)/2$ | $+/-(V_B+V_D)/2$ |
| | 0 | 1 | 0 | 0 | $V_D$ | $(V_B+V_D)/2$ | |
| "ON" | 1 | 0 | 0 | 0 | 0 | $(V_B-V_D)/2$ | $+/-(V_B-V_D)/2$ |
| | 1 | 1 | 1 | $V_B$ | $V_D$ | $(V_B+V_D)/2$ | |

SIMPLIFIED PIXEL CELL CAPABLE OF MODULATING A FULL RANGE OF BRIGHTNESS

RELATED APPLICATIONS

This application claims the benefit of U.S. Provisional Patent Application 60/848,426 filed Sep. 29, 2006, of U.S. Provisional Patent Application 60/849,147 filed Oct. 2, 2006, and of U.S. Provisional Patent Application 60/849,566 filed Oct. 5, 2006, and this application is also a Continuation-in-Part (CIP) of patent application Ser. No. 10/329,645 filed Dec. 26, 2002 now U.S. Pat. No. 7,468,717 and a Continuation-in-Part (CIP) of patent application Ser. No. 10/413,649 filed Apr. 15, 2003 now U.S. Pat. No. 7,443,374, which is a Continuation-in-Part (CIP) of U.S. application Ser. No. 10/329,645 filed Dec. 26, 2002.

BACKGROUND

1. Field of the Invention

This invention relates generally to displays, and in particular to the provision of the voltages required for modulation to individual pixels on pulse width modulated displays.

2. Background

Pulse width modulated displays comprise a significant component of modern display technologies. Plasma display panels (PDPs) and DLP digital micromirror devices (DMD) are two common examples. Some liquid crystal technologies use analog gray scale. Thin film transistor (TFT) displays using analog gray scale techniques are found both in direct view LCDs and in transmissive LCDs used for projection applications. Liquid crystal on silicon (LCOS) displays have been developed for near to eye applications and for projection applications using both these modulation methods. As the concepts and construction of LCOS displays are well known in the art no detailed description is provided.

One early example of a pulse width modulated LCOS display in which the full range of voltage needed to modulate the liquid crystal is provided is presented in Potter et al, "Optical correlation using a phase-only liquid crystal over silicon spatial light modulator", SPIE Vol 1564, pp. 363-372, 1991. (See especially paragraph 4.) FIG. 1A presents a drawing of the prior art pixel and FIG. 1B presents the relationship between the logic states of the LCOS device, the node voltages and the drive voltages delivered to the liquid crystal cell. The limitation of the approach taken in Potter is that the drive rail voltages of the silicon backplane are the only voltages that can be delivered to the individual device pixels, there being no means provided to provide other voltages to the individual pixels.

The prior art pixel is constructed as follows. The pixel circuit 150 comprises a memory element 152 (described as a 6T SRAM memory cell), an XNOR gate 154 (described as a 4 transistor element), and a pixel mirror 156. The memory element 152 is connected to the XNOR gate 154 at node A 158. The XNOR gate 154 is connected to the pixel mirror at node B 160. The XNOR gate is also connected to a universal clock signal 184 at node 168. The liquid crystal cell (not shown) is formed by an array of pixel circuits 150 covered by a counter electrode 170 with a suitable liquid crystal 172 and alignment layers (not shown) in between. The counter electrode voltage is determined by a voltage-conditioning network formed of two resistors 180 and 182 of the same resistance and a capacitor 178. The network is driven at node D 164 by a signal $V_D$ that is in phase with the universal clock signal 184 but which may possess a different voltage amplitude as needed to achieve the required offset voltage at counter electrode 170 to drive the liquid crystal cell. The circuit formed by the resistors 180 and 182 when placed between voltage $V_B$ 182 and ground form an offset DC bias of $\frac{1}{2}V_B$. The capacitor asserts the AC component of the clock signal $V_D$ on the DC bias voltage to create a switching voltage in phase with the universal clock 184 but of a different magnitude. The pixel voltage for each pixel is in phase with the universal clock when the memory cell is loaded with 1 and is out of phase when the memory cell is loaded with 0. The liquid crystal voltage state at an individual pixel follows the rules shown in FIG. 1B.

As is well known in the art, a semiconductor device may be designed to operate over a range of voltages but the range can be limited by other considerations such device operating speed and device heating contributions. These considerations have become more important as semiconductor technology has advanced into finer design rules. Means to break the link between the operating range of the semiconductor device and the liquid crystal cell pixel voltages have been developed to address these issues.

One prior art invention which overcomes some limitations to the use of the semiconductor drive voltages is described in U.S. Pat. No. 6,005,558, Hudson et al, as shown in FIG. 2. FIG. 2 shows a block diagram of an exemplary pixel circuit 250 of a display (not shown) to include a memory storage device 252 and a multiplexer 254. Memory storage device 252 includes complementary input terminals 264 and 266, coupled to data lines ($B_{POS}$) 290 and ($B_{NEG}$) 292, respectively, an enable terminal 258 coupled to word line 262, and a data output terminal 260. Responsive to a write signal on word line 262, memory storage device 252 latches the data bit on output terminal 260. Memory storage device 252 is a static-random-access (SRAM) latch in this example.

Multiplexer 254 includes a first input terminal 297 coupled to first voltage supply terminal (V1) 294, a second input terminal 298 coupled to second voltage supply terminal (V0) 296, an output terminal 299 coupled to pixel electrode 256 (a pixel mirror in this particular embodiment), and a control terminal 268 coupled to output terminal 260 of memory storage device 252.

Thus configured, multiplexer 254, responsive to the data bit asserted on its control terminal 268, is operative to selectively couple pixel electrode 256 with first voltage supply terminal (V1) 297 and second voltage supply terminal (V0) 298. For example, if a bit having a logical high value (e.g., digital 1 or 5 volts) is stored in memory storage device 252, then multiplexer 254 will couple pixel electrode 256 with first voltage supply terminal 297. On the other hand, if a bit having a logical low value (e.g., digital 0 or 0 volts) is stored in memory storage device 252, then multiplexer 252 will couple pixel electrode 256 with second voltage supply terminal (V0) 298.

The use of the data bits stored in memory 252 as a control means allows the pixel electrodes to be driven with digital voltages differing from the voltages used to drive the logic circuitry of the display. As another example, off states (0 volts across a pixel cell) can be asserted on the entire display at one time without changing any of the data stored in the latches of the display. Inspection of FIG. 2 reveals that the pixel is incapable of achieving DC balance without the rewriting of data unless the voltage lines V1 294 and V0 296 are voltage modulated. Static voltages cannot be applied to those line and achieve this. The text of '558 describes the use of a multiplexer external to the cell to deliver these voltages.

Notwithstanding the advantages offered by the use of liquid crystal drive voltages that are independent of the semiconductor supply voltages, the requirement to take extra voltage supply lines across the display surface will lead to a decrease in overall semiconductor yield due to added opportunity for critical defect placement and also adds significantly to the design layout process because space must be found across the entire pixel array for supply lines to allow these added voltages to be asserted uniformly. It is against these competing requirements for performance and simplicity that the present invention is conceived.

SUMMARY

The present invention includes methods, apparatuses and system as described in the written description and claims. The embodiments present alternative designs and methods for supplying liquid crystal drive voltages to the pixels of a pixel array on a liquid crystal cell through combined use of standard semiconductor voltage supplies and a single additional voltage supply able to operate independently of the standard semiconductor voltage supplies.

In a first embodiment of the present invention the voltage supplies available for delivery to the pixel consist of $V_{DD}$ and an independent voltage $V_X$. The independent voltage VX and the common plane voltages can be set us in an optimal manner. The voltage range over which $V_X$ can be set is at least the full range between $V_{DD}$ and $V_{SS}$.

In another embodiment of the present invention the voltage supplied available for delivery to the pixel are $V_{DD}$ and $V_X$ as in the first embodiment of the invention. An alternative version of a pixel level DC balance circuit is used that further simplifies the pixel circuit but with a significant reduction in the range of voltages over which $V_X$ can be set. In one implementation $V_X$ must be approximately one volt above the value of $V_{SS}$ to avoid circuit malfunction.

In a third embodiment of the present invention the pixel voltages available for delivery to the pixel consist of $V_{SS}$ and an independent pixel voltage $V_X$ that can be set up in an optimal manner during system calibration. The range of values to which $V_X$ can be set comprise at least the full range of voltages between $V_{DD}$ and $V_{SS}$.

Other features and advantages of the present invention should be apparent after reviewing the following detailed description and accompanying drawings that illustrate, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts.

DETAILED DESCRIPTION

Figures 1A, 1B:
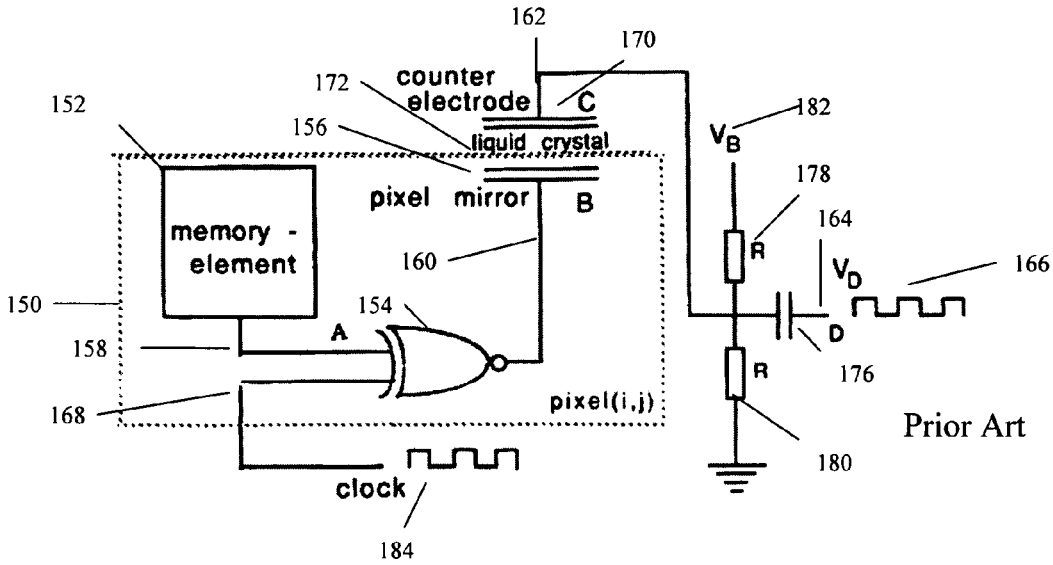
Prior Art Fig 1B
FIG. 1A is a block diagram of a prior art pixel architecture.
FIG. 1B is a table depicting the circuit values under certain conditions of the prior art pixel architecture of FIG. 1A.
Figure 2:
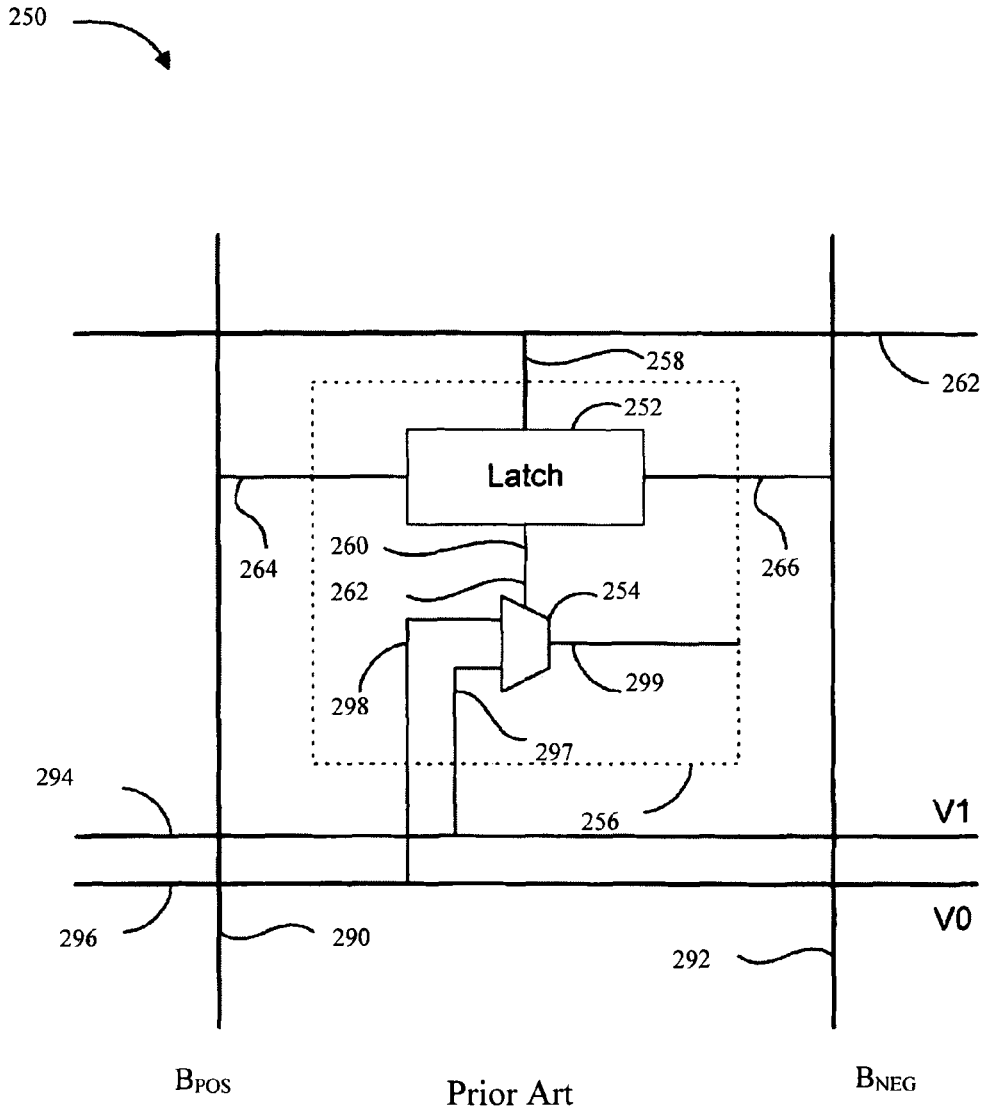
Prior Art Fig 2
FIG. 2 is a block diagram of a second prior art pixel architecture.
Figure 3A:
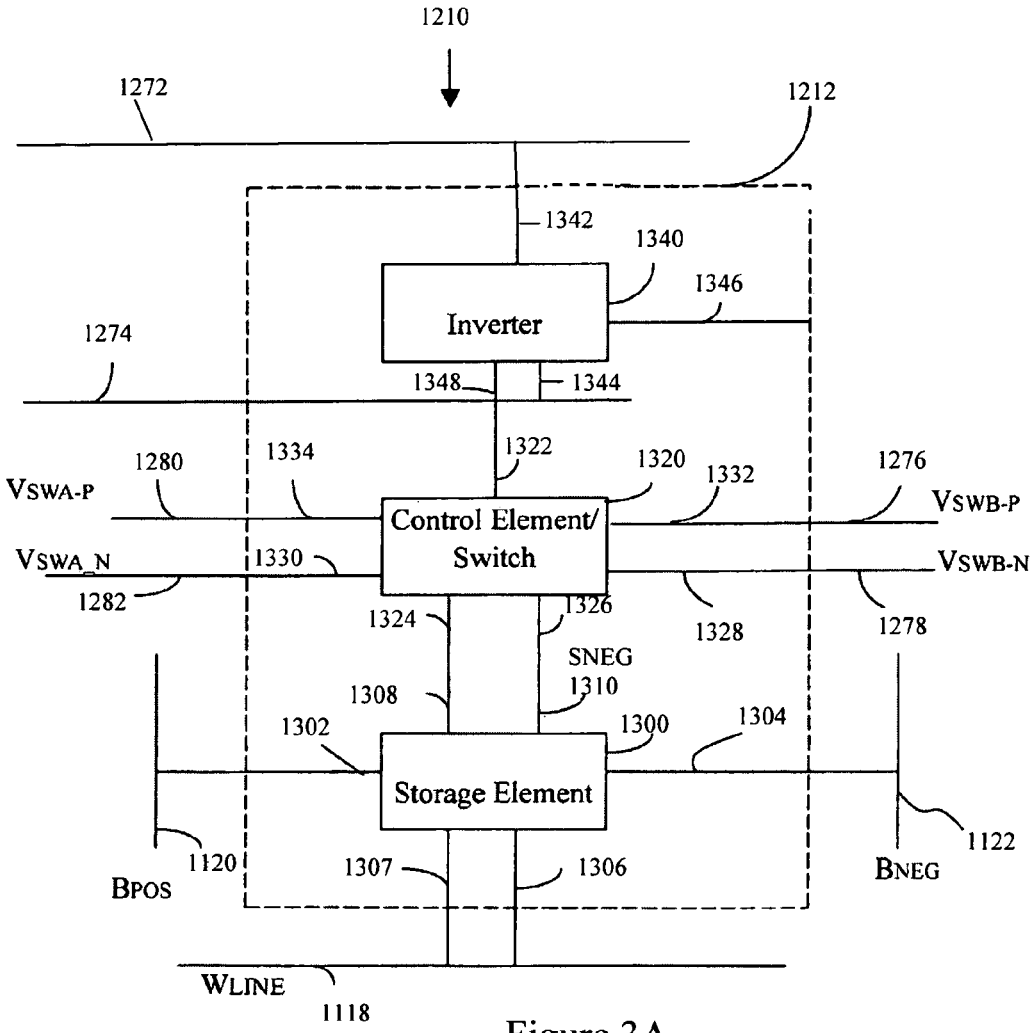
FIG. 3A is a pixel level block diagram of a simplified pixel wherein the pixel logic chooses between a single independently controlled voltage and $V_{DD}$ for delivery to a pixel.
Figure 3B:
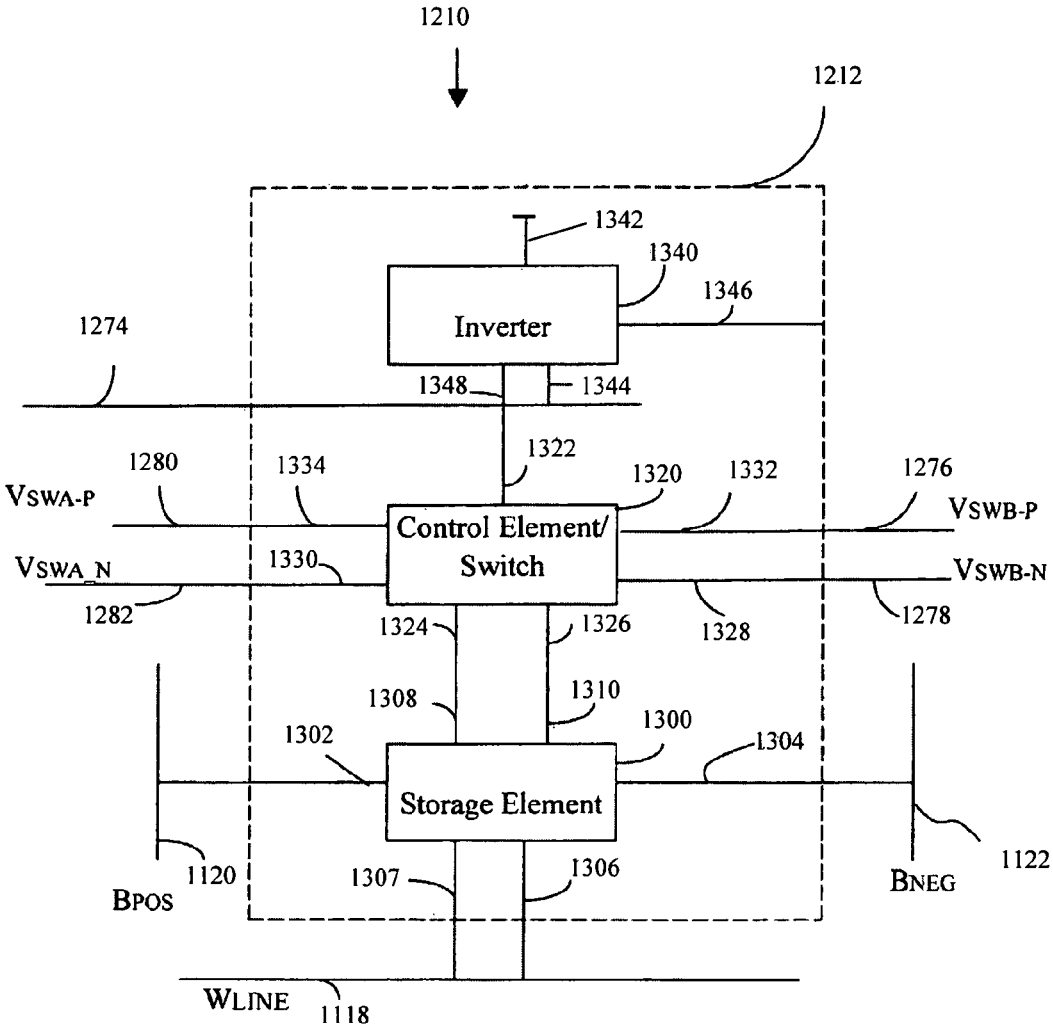
FIG. 3B is an alternative representation of the simplified pixel implementation of FIG. 3A.

A depiction of the first embodiment is presented in FIG. 3A and an alternative depiction of the first embodiment is presented in FIG. 3B. In this embodiment the source of $V_{DD}$ for the connection to the Inverter 1340 may lie within or outside of the physical map of the pixel cell. The choice of connection point is arbitrary and may be chosen to limit noise or bounce effects or to insure the line length is short. The connection of the inverter 1340 to $V_X$ necessarily must take place at the pixel circuit boundary in a manner to be described below. The voltage to be supplied to the pixel mirror is either $V_{DD}$ or $V_X$, depending on the momentary configuration of the combinatory logic element and the SRAM memory of the pixel.

FIG. 3A shows a block diagram of a single pixel cell 1210 of a display in accordance with the present invention. The pixel cell 1210 includes a storage element 1300, a control element or switch 1320, and an inverter 1340. The DC balance control element or switch 1320 is preferably a CMOS based logic device that can selectively pass to another device one of several input voltages. The storage element 1300 includes complementary input terminals 1302 and 1304, respectively coupled to data lines ($B_{POS}$) 1120 and ($B_{NEG}$) 1122. The storage element also includes complementary enable terminals 1306 and 1307 coupled to a word line (WLINE) 1118, and a pair of complementary data output terminals ($S_{POS}$) 1308, and ($S_{NEG}$) 1310. In the present embodiment, storage element 1300 is an SRAM memory device, but those skilled in the art will understand that any storage element capable of receiving a data bit, storing the bit, and asserting the complementary states of the stored bit on complementary output terminals may be substituted for the SRAM storage element 1300 described herein.

The DC balance control element or switch 1320 includes a pair of complementary data input terminals 1324 and 1326 which are coupled respectively to the data output terminals ($S_{POS}$) 1308 and ($S_{NEG}$) 1310 of the storage element 1300. The switch 1320 also includes a first voltage supply terminal 1334, and a second voltage supply terminal 1330, which are coupled respectively to the third voltage supply terminal ($V_{SWA_P}$) 1280, and the fourth voltage supply terminal ($V_{SWA_N}$) 1282 of the voltage control element or switch 1320. The switch 1320 further includes a third voltage supply terminal 1332, and a fourth voltage supply terminal 1328, which are coupled respectively to the fifth voltage supply terminal ($V_{SWB_P}$) 1276, and the sixth voltage supply terminal ($V_{SWB_N}$) 1278 of the voltage control element or switch 1320. The switch 1320 further includes a data output terminal 1322.

The inverter 1340 includes an external connection 1342 to $V_{DD}$ 1272, and a single voltage supply terminal 1344, which is coupled to voltage supply terminal ($V_X$) 1274. The inverter 1340 also includes a data input terminal 1348 coupled to the data output terminal 1322 of the switch 1320, and a pixel voltage output terminal ($V_{PIX}$) 1346 coupled to the pixel mirror 1212. The function of the inverter and voltage application circuit is to insure that the correct voltage among $V_X$ and $V_{DD}$ is delivered to the pixel mirror. It is common practice in semiconductor and circuit board designs for $V_{DD}$ to be brought to the edge of the semiconductor die in multiple instances, especially in dual well and triple well semiconductor technologies. It is also common for different segments of the chip to have different $V_{DD}$ voltage values. These are understood in the context of this invention. It is assumed for the present discussion that the value of $V_{DD}$ is higher than the value that $V_X$ is set to. It is certain a version of the invention will work if $V_X$ is set to a voltage setting lower than $V_{SS}$ although this has not been tested on the design presented here.

FIG. 3B presents an alternative to the structure presented in FIG. 3A. In this alternative the separate line 1272 for $V_{DD}$ is eliminated and the Inverter terminal 1342 is connected directly to a local $V_{DD}$ line (not shown). The pixel circuit components are otherwise identical to the pixel circuit of FIG. 3A so no further explanation is required.

Figure 4:
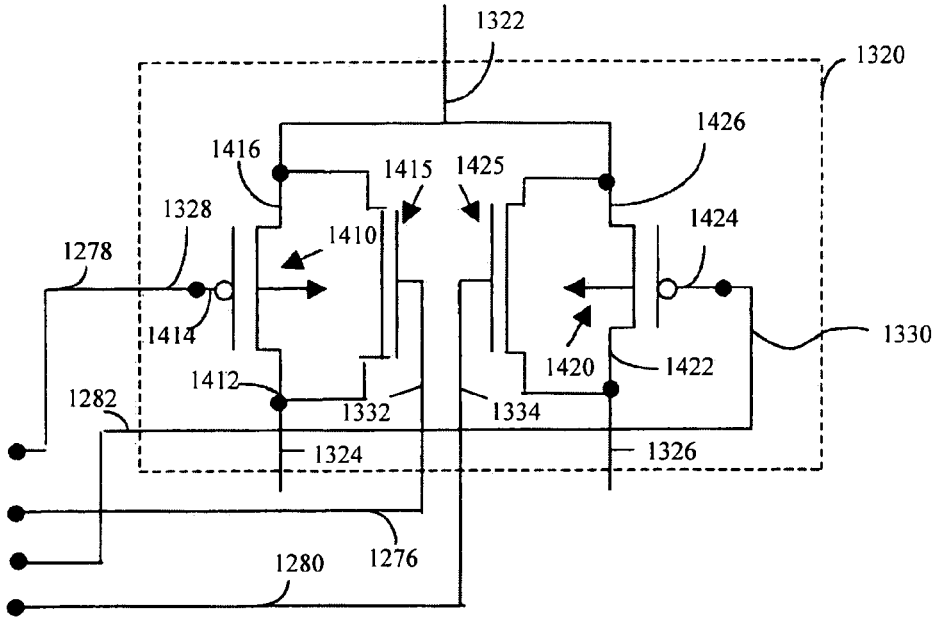
FIG. 4 presents a pixel level DC balance control circuit capable of delivering a full range of voltage to a pixel mirror.

FIG. 4 shows a schematic of a preferred embodiment of the switch 1320. The DC balance control switch 1320 includes a first p-channel CMOS transistor 1410 connected in parallel with an n-channel transistor 1415 and a second p-channel CMOS transistor 1420 connected in parallel with a second n-channel transistor 1425. The first p-channel transistor 1410 and the first n-channel transistor 1415 include a source terminal 1412 coupled to the input terminal 1324. The second p-channel transistor 1420 and the second n-channel transistor second transistor 1425 include a source terminal 1422 coupled to the input terminal 1326. The drain terminals 1416 and 1426 of the first and second p-channel and n-channel transistors respectively are connected the data output terminal 1322. The gate terminal 1414 of p-channel transistor 1410 is connected to a voltage terminal supply $V_{SWB_N}$ 1278 via link 1328, the gate 1332 of the first n-channel transistor 1415 is connected to a voltage supply terminal $V_{SWB_P}$ 1276. The gate 1424 of the second p-channel transistor 1420 is connected to a voltage supply terminal $V_{SWA_N}$ 1282 via link 1330, and the gate 1334 of the second n-channel transistor 1425 is connected to a voltage supply terminal $V_{SWA_P}$ 1280.

Figure 5A:
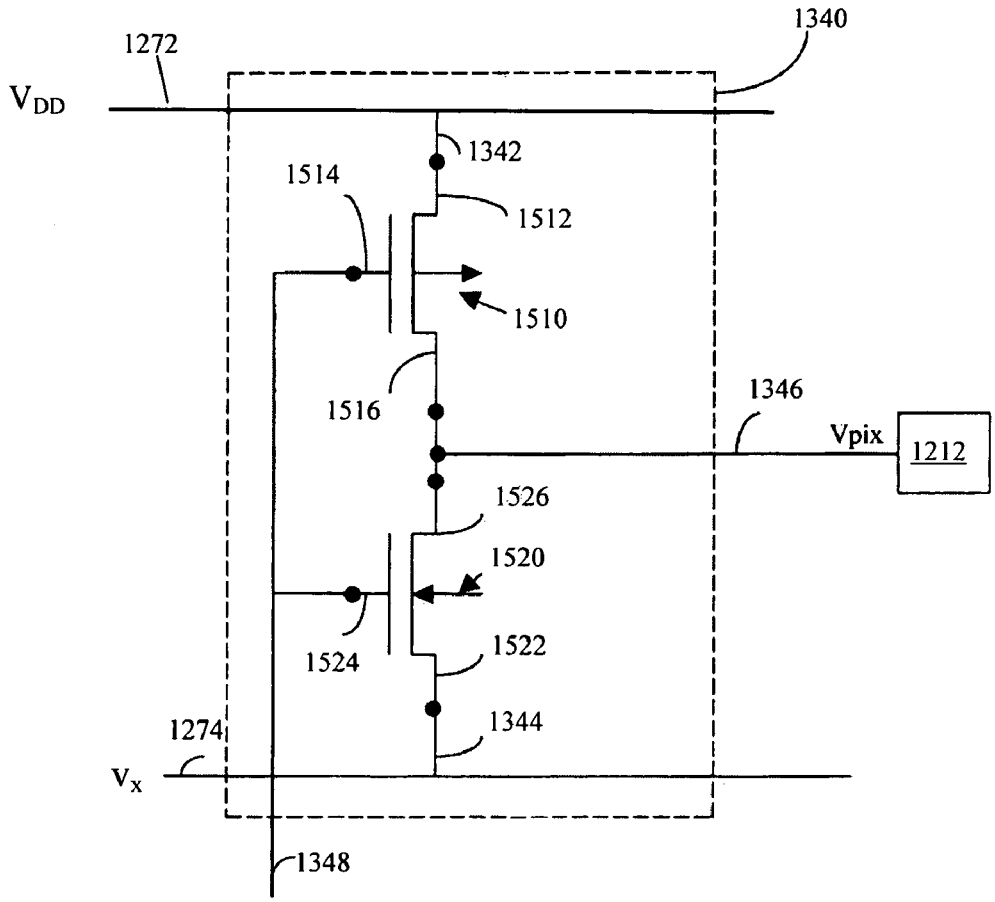
FIG. 5A presents an inverter used to apply voltages to a pixel mirror depicted in the manner of FIG. 3A.

FIG. 5A shows a drawing of a preferred embodiment of the inverter 1340 implementing the first embodiment presented in FIG. 3A. The inverter 1340 includes a p-channel CMOS transistor 1510 and an n-channel transistor 1520. The p-channel transistor 1510 includes a source terminal 1512 connected to the first voltage supply terminal 1342 which is in turn connected to the $V_{DD}$ supply line 1272, a gate terminal 1514 coupled to the data input terminal 1348, and a drain terminal 1516 coupled to the pixel voltage output terminal ($V_{PIX}$) 1346 which in turn connects to pixel mirror electrode 1212. The n-channel transistor 1520 includes a source terminal 1522 coupled to the second voltage supply terminal 1344 which is in turn connected to the $V_X$ voltage supply line 1274, a gate terminal 1524 coupled to the data input terminal 1348, and a drain terminal 1526 coupled to the pixel voltage output terminal ($V_{PIX}$) 1346.

Figure 5B:
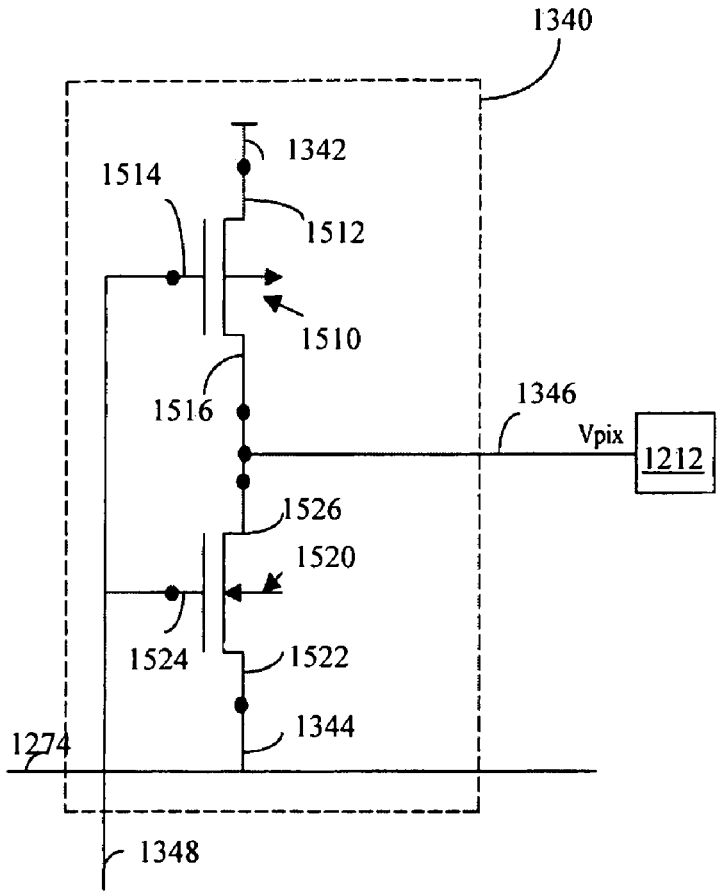
FIG. 5B presents an inverter used to apply voltages to a pixel mirror depicted in the manner of FIG. 3B.

FIG. 5B shows a schematic of the alternate to the first preferred embodiment of the inverter 1340 implementing the embodiment presented in FIG. 3B. The inverter 1340 includes a p-channel CMOS transistor 1510 and an n-channel transistor 1520. The p-channel transistor 1510 includes a source terminal 1512 connected to the first voltage supply terminal 1342 which is in turn directly connected to a local $V_{DD}$ source (not shown), a gate terminal 1514 coupled to the data input terminal 1348, and a drain terminal 1516 coupled to the pixel voltage output terminal ($V_{PIX}$) 1346. The n-channel transistor 1520 includes a source terminal 1522 coupled to the second voltage supply terminal 1344 which is in turn connected to the $V_X$ supply line 1274, a gate terminal 1524 coupled to the data input terminal 1348, and a drain terminal 1526 coupled to the pixel voltage output terminal ($V_{PIX}$) 1346 which in turn connects to pixel mirror electrode 1212.

Figure 6:
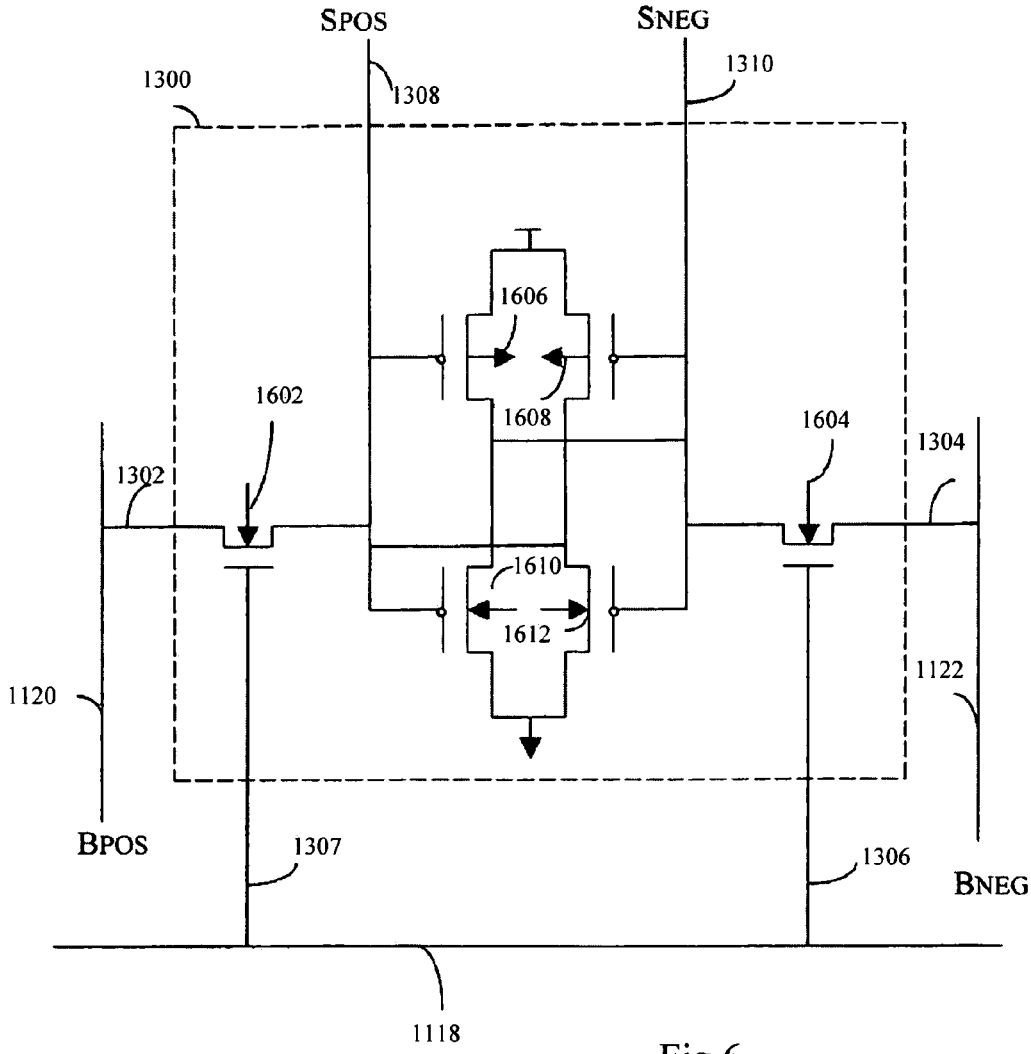
FIG. 6 presents a six-transistor SRAM memory device of the type used in all embodiments of the present invention.

FIG. 6 shows a preferred embodiment of a storage element 1300. The storage element 1300 is preferably a CMOS static ram (SRAM) latch device. Such devices are well known in the art. See DeWitt U. Ong, Modern MOS Technology, Processes, Devices, & Design, 1984, Chapter 9-5, the details of which are hereby fully incorporated by reference into the present application. A static RAM is one in which the data is retained as long as power is applied, though no clocks are running. FIG. 6 shows the most common implementation of an SRAM cell in which six transistors are used. Transistors 1602, 1604, 1610, and 1612 are n-channel transistors, while transistors 1606, and 1608 are p-channel transistors. In this particular cell, the word line 1118 turns on the two pass transistors 1602 and 1604, allowing the ($B_{POS}$) 1120, and the ($B_{NEG}$) 1122 lines to remain at a pre-charged high state or be discharged to a low state by the flip flop (i.e., transistors 1606, 1608, 1610, and 1612). Differential sensing of the state of the flip-flop is then possible. In writing data into the selected cell, ($B_{POS}$) 1120 and ($B_{NEG}$) 1122 are forced high or low by additional write circuitry. The side that goes to a low value is the one most effective in causing the flip-flop to change state.

The six-transistor SRAM cell is desired in CMOS type design and manufacturing since it involves the least amount of detailed circuit design and process knowledge and is the safest with respect to noise and other effects that may be hard to estimate before silicon is available. In addition, current processes are dense enough to allow large static RAM arrays. These types of storage elements are therefore desirable in the design and manufacture of liquid crystal on silicon display devices as described herein. However, other types of static RAM cells are contemplated by the present invention, such as a four transistor RAM cell using a NOR gate, as well as using dynamic RAM cells rather than static RAM cells.

As configured, the switch 1320, being responsive to a predetermined voltage on the first set of logic voltage supply terminals 1278 ($V_{SWB_N}$) and 1276 ($V_{SWB_P}$) and a predetermined voltage on the second set of logic voltage supply terminals 1282 ($V_{SWA_N}$) and 1280 ($V_{SWA_P}$), can selectively direct either one of the high or low data values that are stored in the storage element 1300, through the output terminal 1322 of the switch 1320 and into the input terminal 1348 of the inverter 1340. Specifically, the voltages of the voltage supply terminals and the output voltage $V_{PIX}$ to the pixel electrodes after a pixel write operation corresponding to the states of the input terminals $B_{POS}$ and $B_{NEG}$ to the storage element (referring to FIG. 6) are shown in the Table 1 as set forth below:

TABLE 1

| $V_{SWB_P}$ | $V_{SWA_P}$ | $B_{POS}$ | $B_{NEG}$ | $V_{PIX}$ |
|---|---|---|---|---|
| 1 | 0 | 1 | 0 | w |
| 0 | 1 | 1 | 0 | b |
| 1 | 0 | 0 | 1 | b |
| 0 | 1 | 0 | 1 | w |
| 0 | 0 | x | x | b |
| 1 | 1 | x | x | w |

Where 1 represents an on state and 0 represents an off state, w represents a white voltage typically but not always around 3 volts and b represents a black voltage typically but not always around 1 volt. The state of $V_{SWA_P}$=1 and $V_{SWB_P}$=1 is a defective state and should be avoided.

Figure 7A:
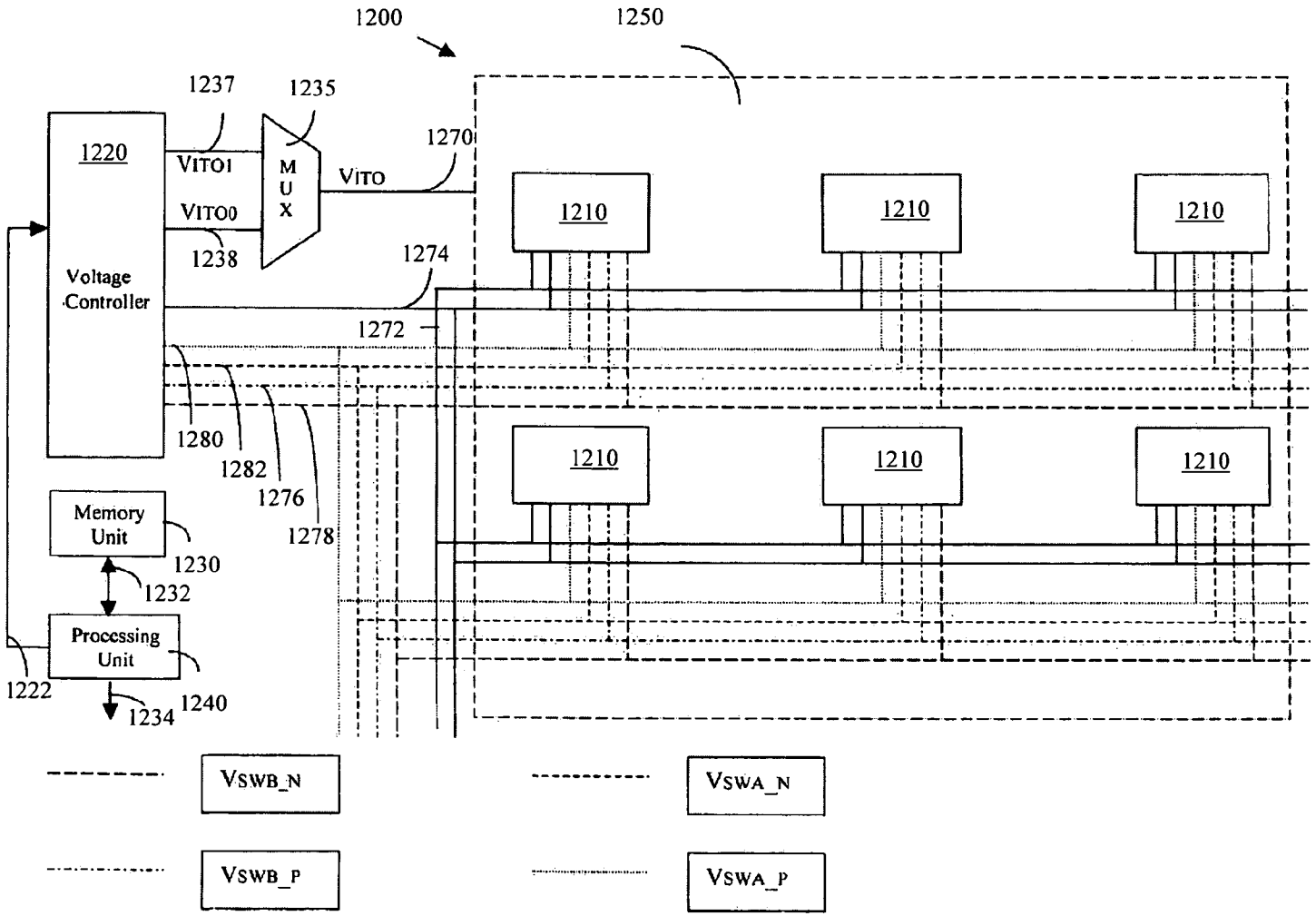
FIG. 7A presents a block diagram of a display device built using pixel circuits after the fashion of FIG. 3A.

FIG. 7A shows a display system 1200 in accordance with the present invention. Minor variations similar to the following are envisioned within the scope of this invention. The display system 1200 includes an array of pixel cells 1210, a voltage controller 1220, a processing unit 1240, a memory unit 1230, and a transparent common electrode 1250. The common transparent electrode overlays the entire array of pixel cells 1210. In a preferred embodiment, pixel cells 1210 are formed on a silicon substrate or base material, and are overlaid with an array of pixel mirrors 1212 and each single pixel mirror 1212 corresponding to each of the pixel cells 1210. A substantially uniform layer of liquid crystal material is located in between the array of pixel mirrors 1212 and the transparent common electrode 1250. The transparent common electrode 1250 is preferably formed from a glass substrate coated with a transparent conductive material such as Indium Tin-Oxide (ITO). The memory 1230 is a computer readable medium including programmed data and commands. The memory is capable of directing the processing unit 1240 to implement various voltage modulation and other control schemes. The processing unit 1240 receives data and commands from the memory unit 1230, via a memory bus 1232, provides internal voltage control signals, via voltage control bus 1222, to voltage controller 1220, and provides data control signals (i.e. image data into the pixel array) via data control bus 1234. The voltage controller 1220, the memory unit 1230, and the processing unit 1240 are preferably located on a different portion of the display system than that of the array of pixel cells 1210.

Figure 15:
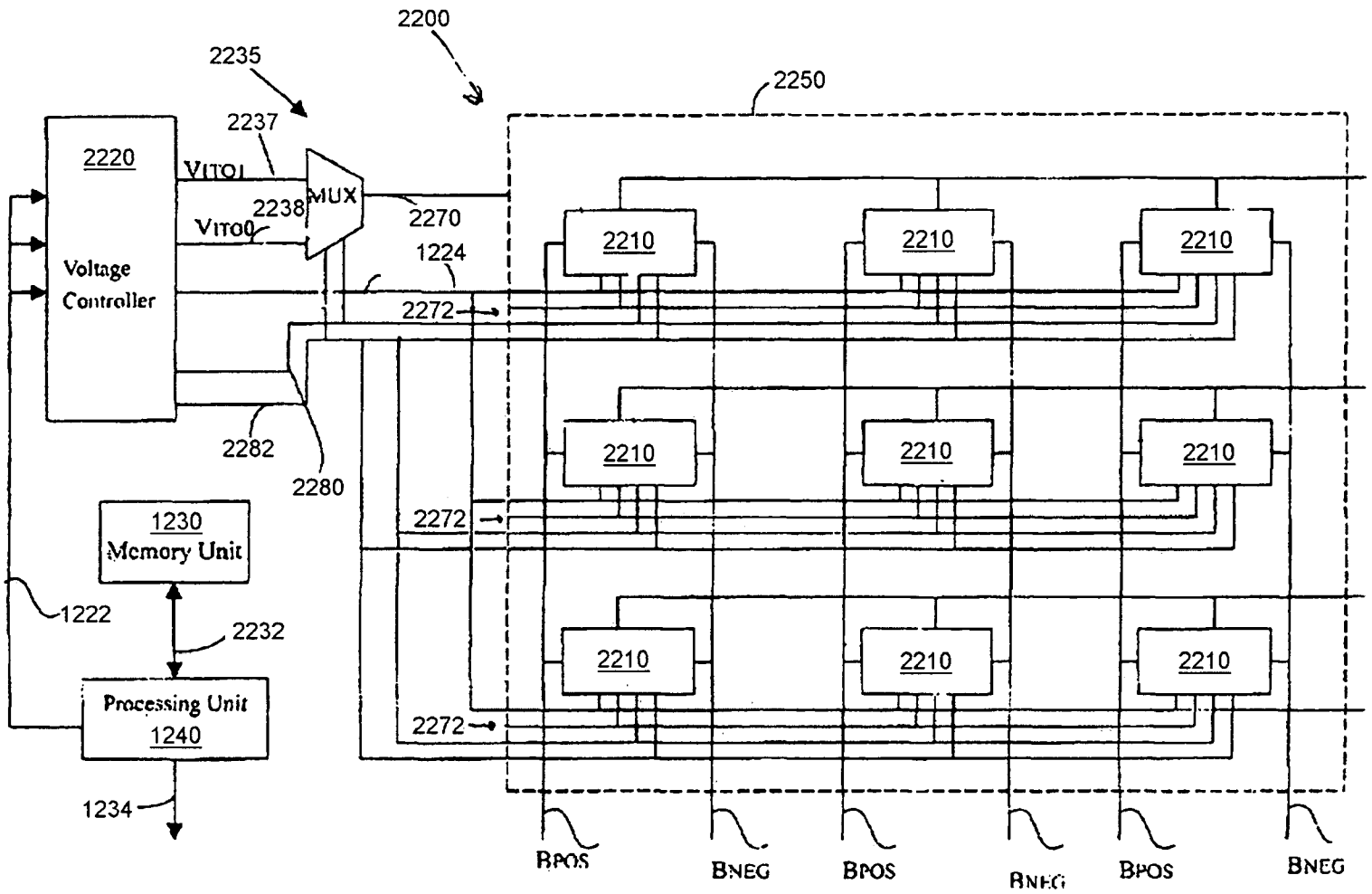
FIG. 15 presents a display system incorporating the simplified pixel cell of FIG. 13A.

Responsive to control signals received from the processing unit 1240, via the voltage control bus 1222, the voltage controller 1220 provides a single predetermined voltage to each of the pixel cells 1210 via a single voltage supply terminal ($V_X$) 1274, a second (logic) voltage supply terminal ($V_{SWB_P}$) 1276, and a third (logic) voltage supply terminal ($V_{SWB_N}$) 1278, a fourth (logic) voltage supply terminal ($V_{SWA_P}$) 1280, and a fifth (logic) voltage supply terminal ($V_{SWA_N}$) 1282. A second voltage is supplied for application to the pixel mirror by direct connection to $V_{DD}$ 1272. The voltage controller 1220 also supplies predetermined voltages $V_{ITO_L}$ by voltage supply terminal 1236 and $V_{ITO_H}$ by voltage supply terminal 1237 to ITO voltage multiplexer unit 1235. Voltage multiplexer unit 1235 selects between $V_{ITO_L}$ and $V_{ITO_H}$ based on the logic state of ($V_{SWB_P}$) 1276, ($V_{SWB_N}$) 1278, ($V_{SWA_P}$) 1280, and ($V_{SWA_N}$) 1282. The ITO voltage multiplex unit delivers $V_{ITO}$ to the transparent common electrode 1250, via a voltage supply terminal ($V_{ITO}$) 1270. Each of the voltage supply terminals ($V_X$) 1274, ($V_{SWB_P}$) 1276, ($V_{SWB_N}$) 1278, ($V_{SWA_P}$) 1280, ($V_{SWA_N}$) 1282, and ($V_{ITO}$) 1270 are shown in FIG. 7A as global signals, where the same voltage is supplied to each pixel cell 1210 throughout the entire pixel array or to the transparent common electrode 1250 only in the case of $V_{ITO}$ 1270. Signal distribution layouts differing from the one depicted in FIG. 15 are well known to those skilled in the art of semiconductor or backplane design and are considered to be encompassed within this design.

Figure 7B:
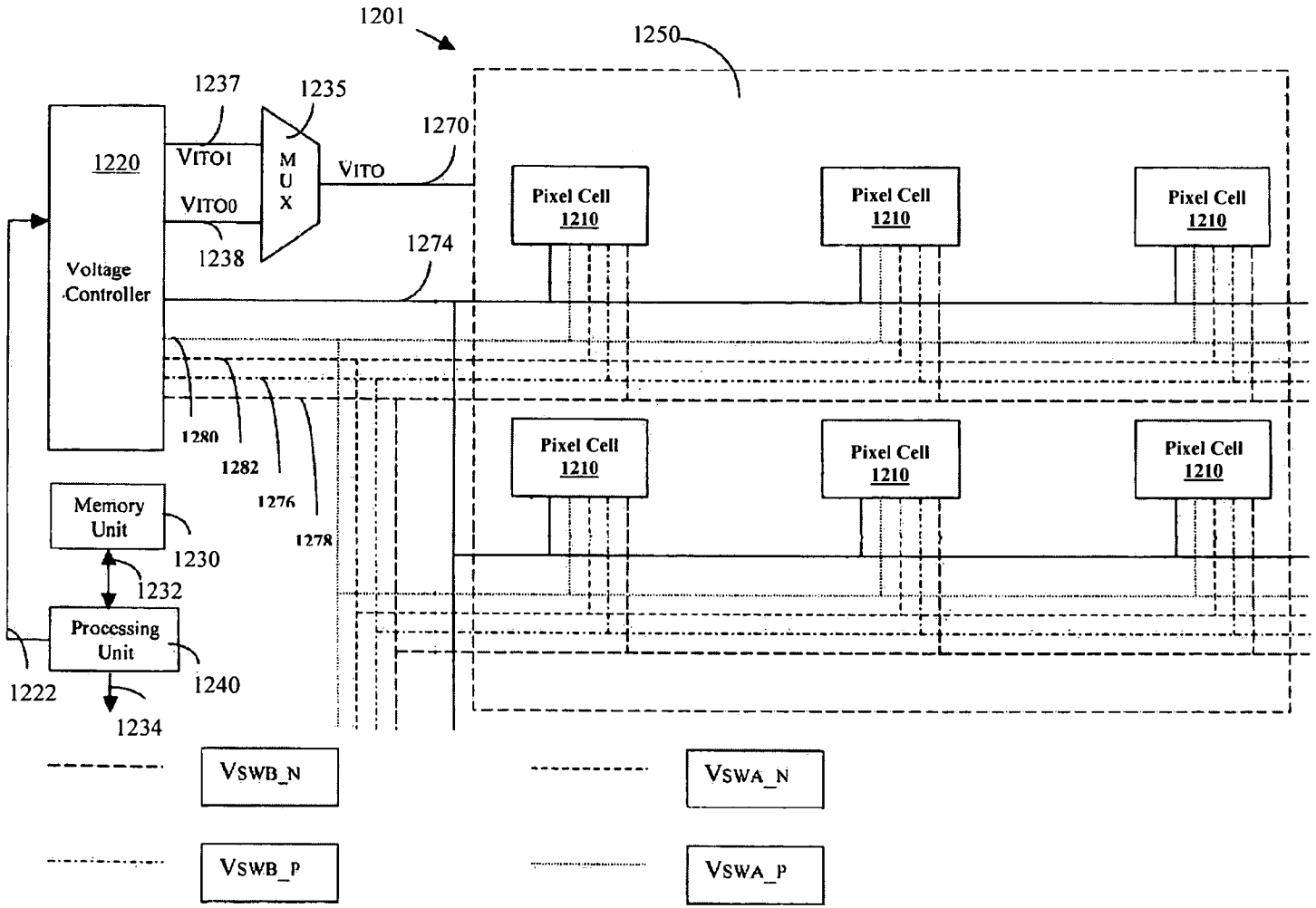
FIG. 7B presents a block diagram of a display device built using pixel circuits after the fashion of FIG. 3B.

FIG. 7B presents the configuration of alternative display 1201 of capability identical to that of display 1200 of FIG. 7A. In FIG. 7B the separate VDD line 1272 is now omitted and the connection of the inverter to $V_{DD}$ is made in the vicinity of the pixel to a $V_{DD}$ line as indicated on FIG. 5B.

Figure 8:
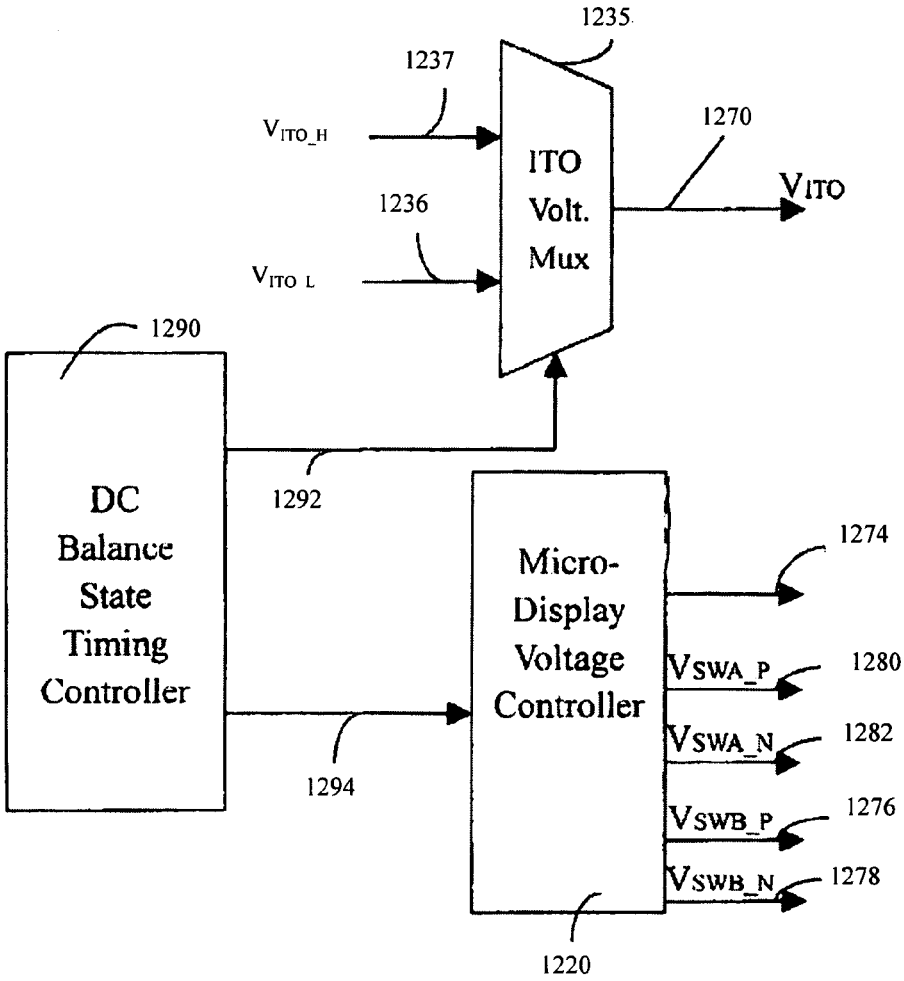
FIG. 8 presents an alternative device to manage the DC balance state of a display device.

FIG. 8 shows an alternative embodiment for control of the ITO voltage multiplexer. In FIG. 8 the DC balance timing controller 1290 controls voltage multiplexer 1235 via the control line 1292. In like manner the timing of state changes of $V_{SWA_P}$, $V_{SWA_N}$, $V_{SWB_P}$, and $V_{SWB_N}$ are controlled by control line 1294. Through exercise of control in this manner, minor differences in the timing of changes to $V_{ITO}$ and selection between $V_{DD}$ and $V_X$ are enabled. This may be necessary because the transparent common electrode commonly has a surface area in the range of 50 to 100 square millimeters whereas the surface area of each pixel electrode is in the range of 0.001 square millimeters or less. The states of the DC balancing in response to the state changes of $V_{SWA_P}$, $V_{SWA_N}$, $V_{SWB_P}$, and $V_{SWB_N}$ as that controlled by the control line 1294 are shown in Table 2 below:

TABLE 2

| Status | | Resulting State | | |
|---|---|---|---|---|
| $V_{SWA_P}$ | $V_{SWB_P}$ | "A" | "B" | Comments |
| 0 | 0 | 0 | 0 | DC balance transitioning |
| 1 | 0 | 0 | 1 | DC balance state 1 |
| 0 | 1 | 1 | 0 | DC balance state 0 |
| 1 | 1 | 1 | 1 | Defective state to be avoided |

When $V_{SWA_N}$=($V_{SWA_P}$) and $V_{SWB_N}$=($V_{SWB_P}$) an entry into a defective state will occur that will short the memory element resulting in a reset to zero. This should be avoided in the design of the controller.

Figure 9A:
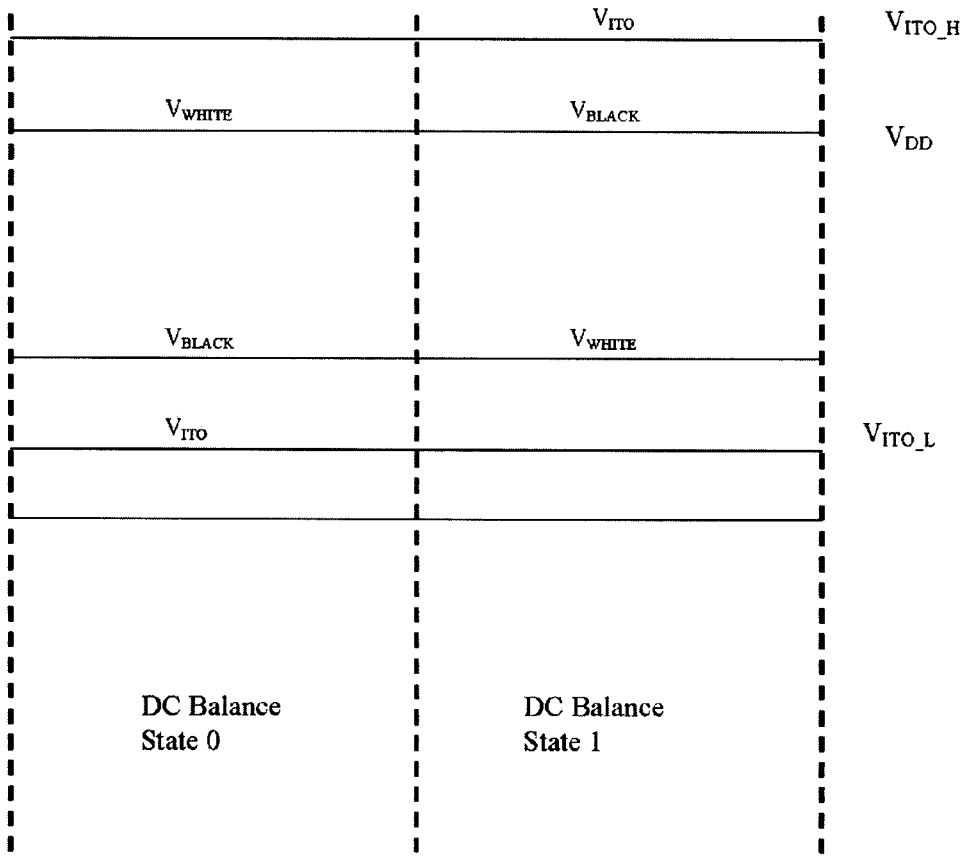
FIG. 9A depicts a voltage versus time description of a full DC balance cycle.
Figure 9B:
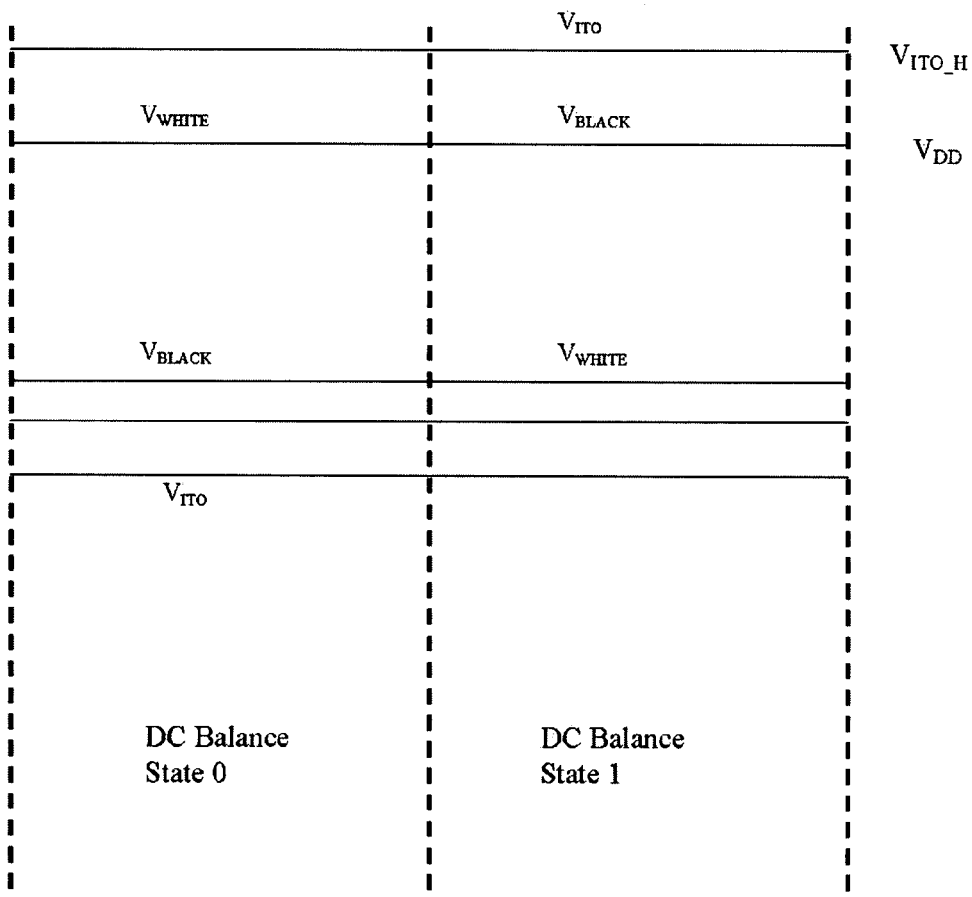
FIG. 9B depicts an alternative voltage versus time description of a full DC balance cycle.

Two examples of the relative voltage variations possible for different states of DC balancing are further described in FIGS. 9A and 9B. In FIG. 9A and FIG. 9B it is to be assumed that the DC Balance State 0 frame and DC Balance State 1 frame present similar absolute values of the voltage differences between the $V_{WHITE}$, $V_{BLACK}$ and $V_{ITO}$ and that the duration of the frames are approximately equal. The values should be as close as possible but may vary slightly and still be sufficient as is well known to those of ordinary skill in the art. In FIG. 9A $V_X$ is set to a point that permits $V_{ITO}$ to exceed the value of ground. This is a common occurrence as is the situation depicted in FIG. 9B, where the lower ITO value is less than the value of $V_{SS}$. Either may occur as a result of different material properties, the wavelength of the light or the voltage handling characteristics of the device semiconductor material.

In both FIG. 9A and FIG. 9B three voltages are active at one time. The active voltages are labeled as $V_{BLACK}$, $V_{WHITE}$ and $V_{ITO}$. Only two voltages are available to the pixel electrode whereas the ITO common plane switches between voltages depending on which DC balance phase is in use.

The liquid crystal cell may be considered as fully DC balanced when the liquid crystal cell dwells in State 0 and State 1 for equal intervals of time. The multiplexing of the common plane voltage from two source voltages thus completes the DC balancing of the cell when said multiplexing of the common plane takes place in time synchronized with the multiplexing of the individual pixels of the liquid crystal cell.

All the above elements work together to provide a pixel design and liquid crystal device where the DC. balancing of the device is not directly tied to the writing of data. Indeed, the logic lines $V_{SWA_P}$ and $V_{SWB_P}$ always control the DC balance state of the liquid crystal device by controlling the ITO voltage and the selection of pixel mirror voltage without requiring change of the data state of the individual pixels on the display.

Figure 10:
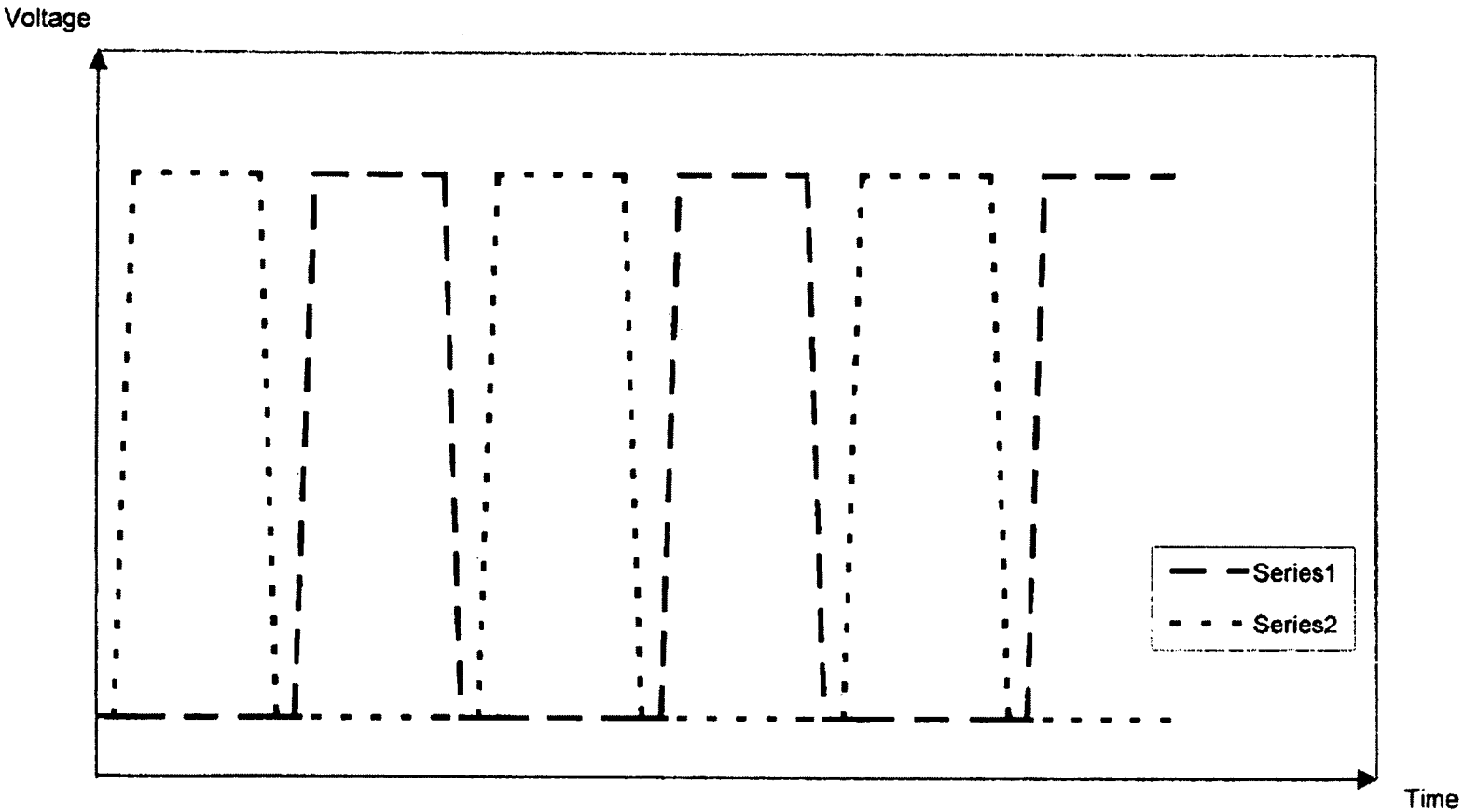
FIG. 10 depicts the voltage state of a pixel mirror during a series of DC balance events.
Figure 11A:
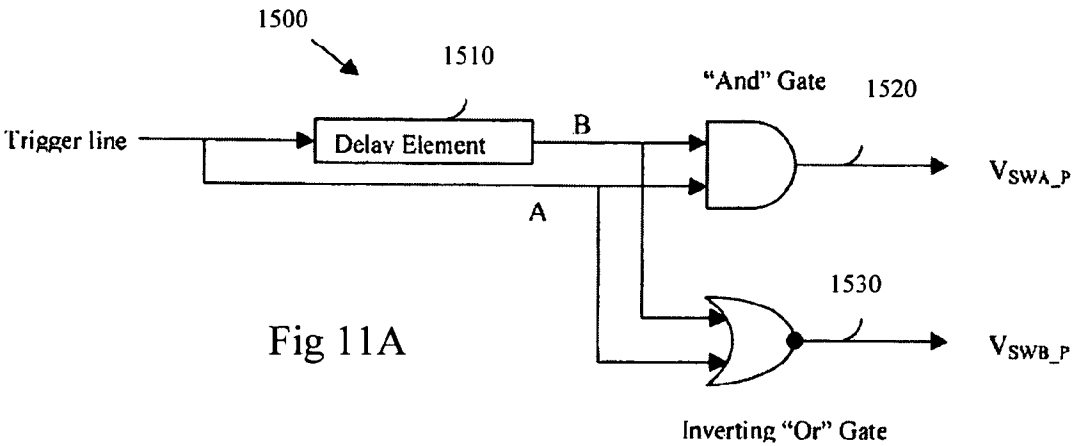
FIG. 11A presents a block diagram of a "break before make" circuit of the type required to operate the pixel level DC balance circuit of FIG. 4
Figure 11B:
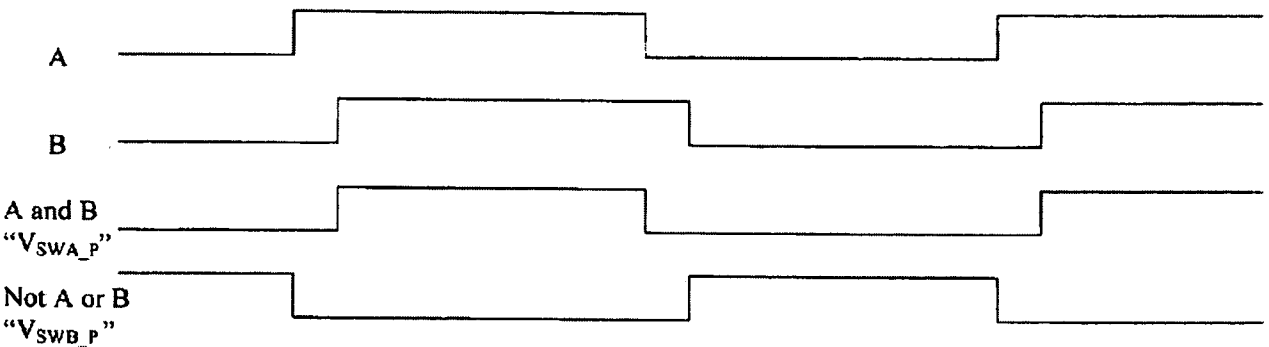
FIG. 11B presents a logic state diagram depicting the output states based on input states in FIG. 11A.

There is a restriction that must be followed by the logic controller 1320 to assure that these two controlling voltage $V_{SWA_P}$ and $V_{SWB_P}$ are not held high at the same time. Therefore, the circuit must be driven by a logic circuit to assure a time sequence to achieve "break before make" as that shown in FIG. 10 where two different kinds of dotted lines voltage-timing diagram represent the high and low state of two controlling voltage of $V_{SWA_P}$ and $V_{SWB_P}$. In order to achieve this break before make voltage sequences, a timing control circuit 1300 is implemented as shown in FIG. 11A that includes a delay element 1510 connected to an AND gate 1520 for outputting the voltage $V_{SWA_P}$ and an inverting OR gate 1530 for outputting the voltage $V_{SWB_P}$. As shown in FIG. 11B, the output B is delayed by the delay element 1510 and the AND gate and the inverting OR gate generate two output voltages A-AND-B and NOT-A-OR-B as $V_{SWA_P}$ and $V_{SWB_P}$ respectively that have a break-before-make timing relationship.

Figure 11C:
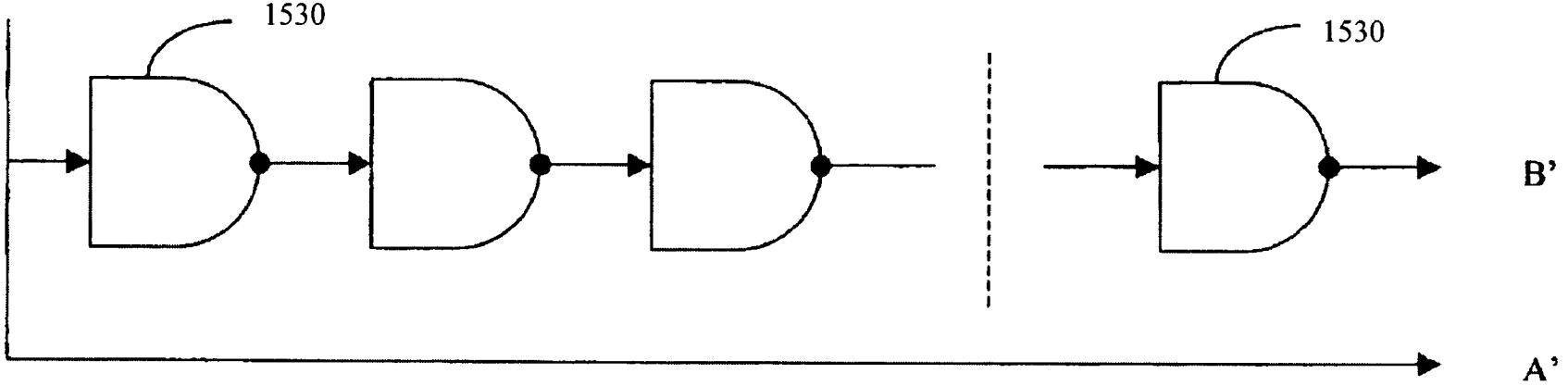
FIG. 11C depicts a delay circuit based on a series of inverters.
Figure 11D:
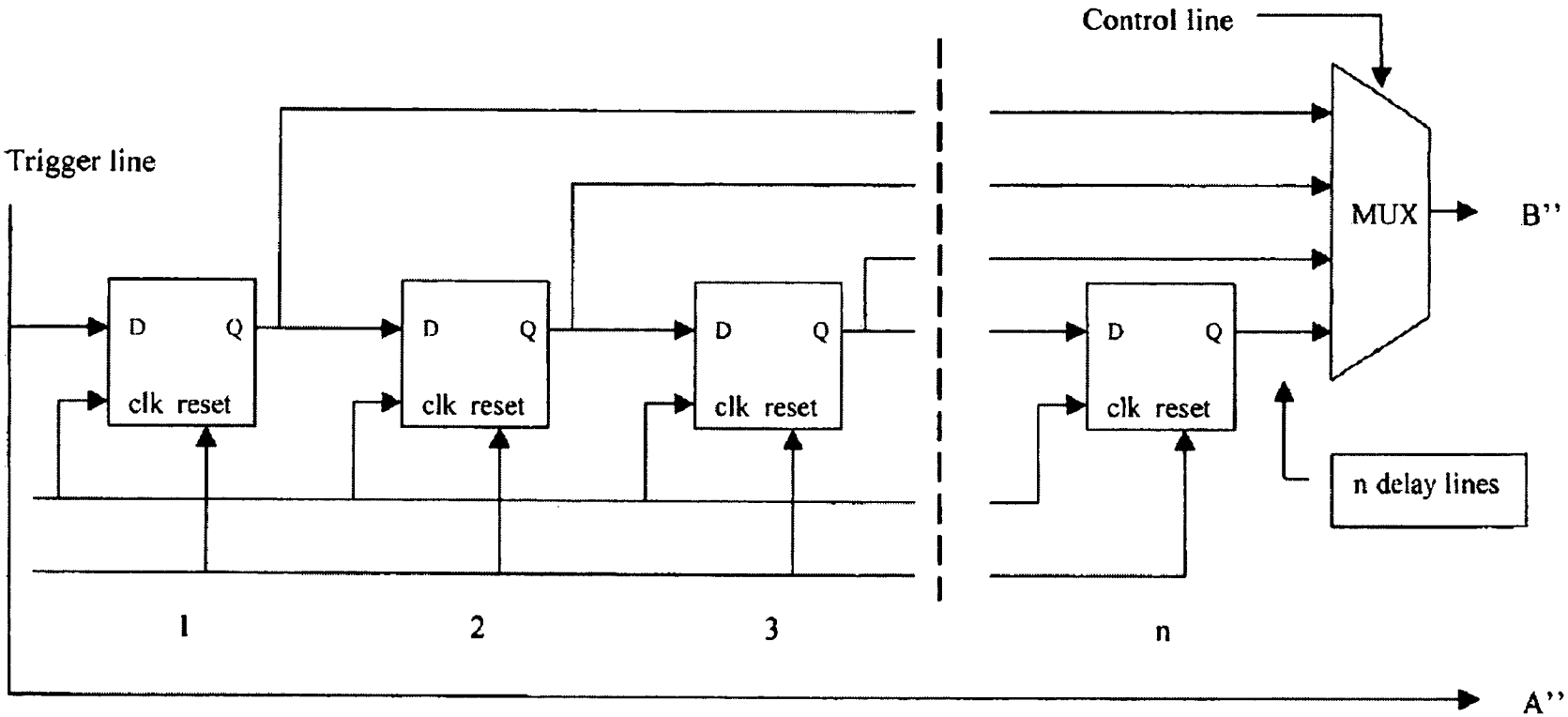
FIG. 11D depicts a delay circuit based on a series of flip-flops.
Figure 11E:
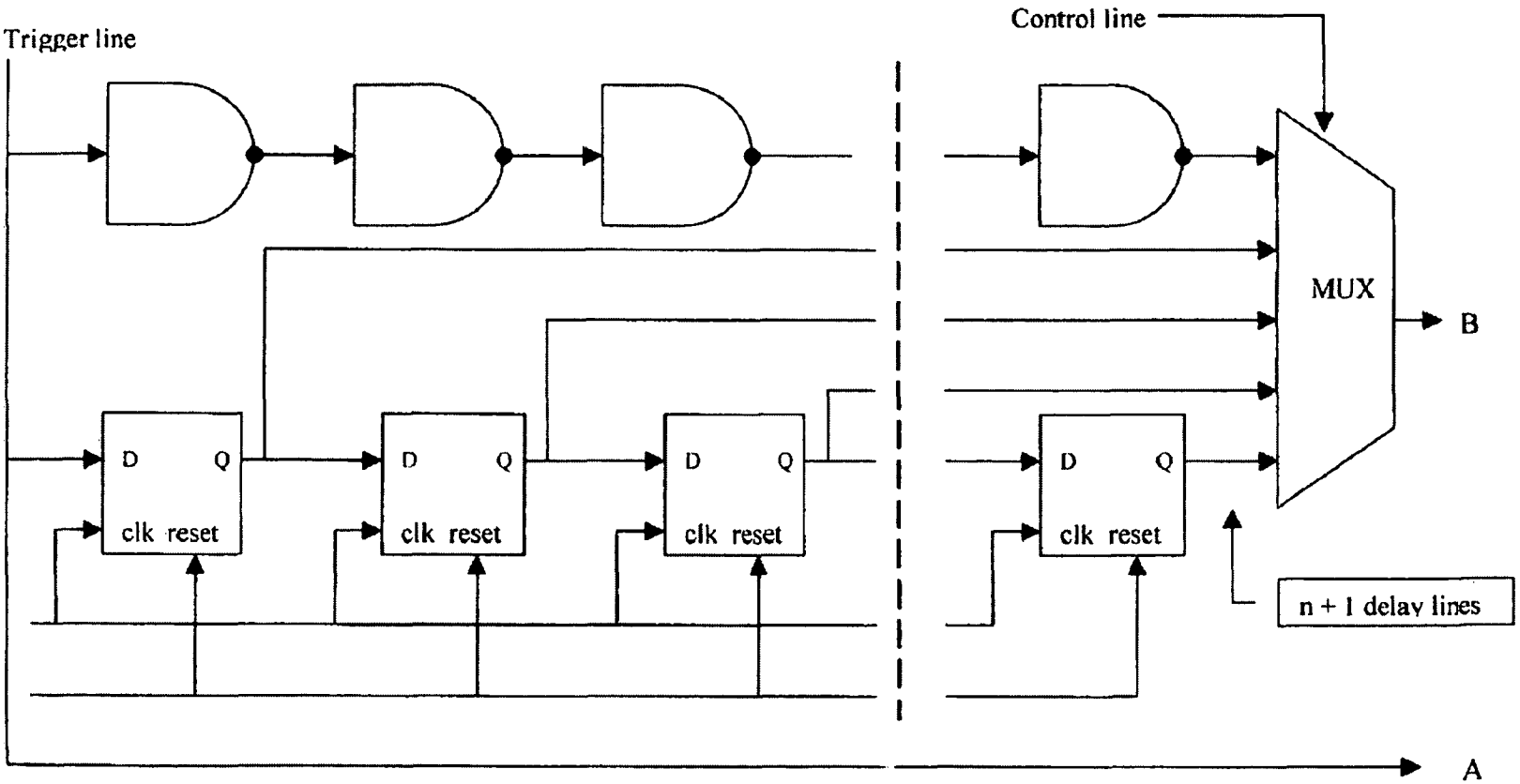
FIG. 11E depicts a delay circuit wherein the delay circuits of FIG. 11C and FIG. 11D are implemented in parallel, the series of inverters being used during startup when the required clock signals are not yet stable.

In order to implement the delay element 1510, FIG. 11C shows one preferred embodiment of a delay-timing circuit wherein the delay is created by successive execution delay of a series of inverters. The delay resulted from the execution operation of the inverter 1530 is of fixed delay duration not tied to clock cycles. To assure that the output of the circuit along the time line B' has the same polarity as the input signal, the number of inverters must be even. This type of time delay circuits may be used at startup to assure that the chip does not enter into a latch-up or other hazard condition during the initialization stage as the system clock first starts to run. The delay time line is marked as B' and the non-delay time line is marked as A'. In FIG. 11D, another delay element with selectable delay is illustrated. The flip-flop circuits are "D" type device. This relieves the requirement to have an even number of devices. The output of each flip-flop (except the last) feeds another flip-flop that adds further delay. Additional each output is tapped and fed into a multiplex selector circuit that enables the system to be configured to permit selectable delay. The number of flip-flops required can be determined during design by skew analysis and during operation through a trial and error or analysis or a combination thereof. The period of the clock, for example, might be set to be near the value of the break cycle off time to minimize the number of flip-flops. Other combinations are possible. FIG. 11D shows one preferred embodiment with n flip-flops here. The output of the delay line is B". The non-delayed parallel signal is A". FIG. 11E shows another embodiment of the delay element by combining two types of delay circuits as shown in. FIGS. 11C and 11D above. The inverter chain may be used to establish delay during the power up phase when clocks are unsettled. After that the system can switch to the appropriate flip-flop circuit tap. This substantially reduces the startup hazard by reducing the likelihood of the risk that a latch-up occurs during chip initialization. The number of flip-flops and the number of inverters need not be equal. The number of each will be determined by the timing delay required. Each chain can receive the same input—the selection between one and the other is done in the multiplexer. Again, time-line B'" is for the delayed signal and time line A'" is for the non-delayed signal.

Figure 12A:
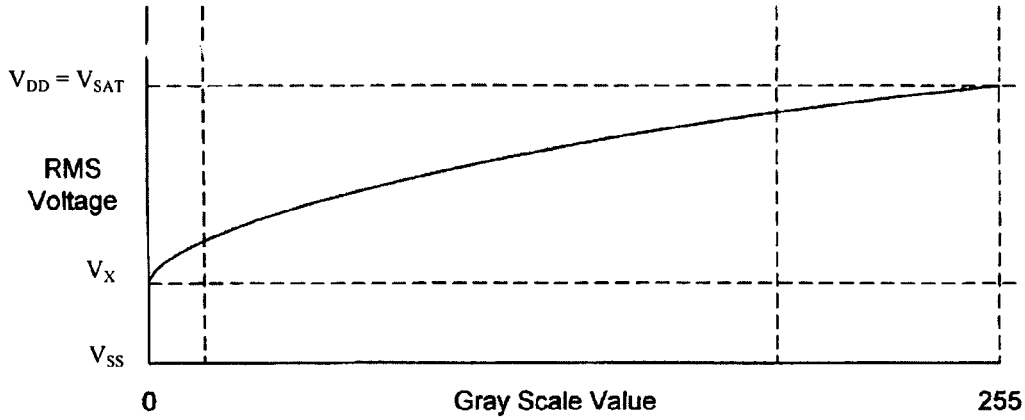
FIG. 12A depicts a liquid crystal device operating between a fully saturated "on" state and a full "off" state.
Figure 12B:
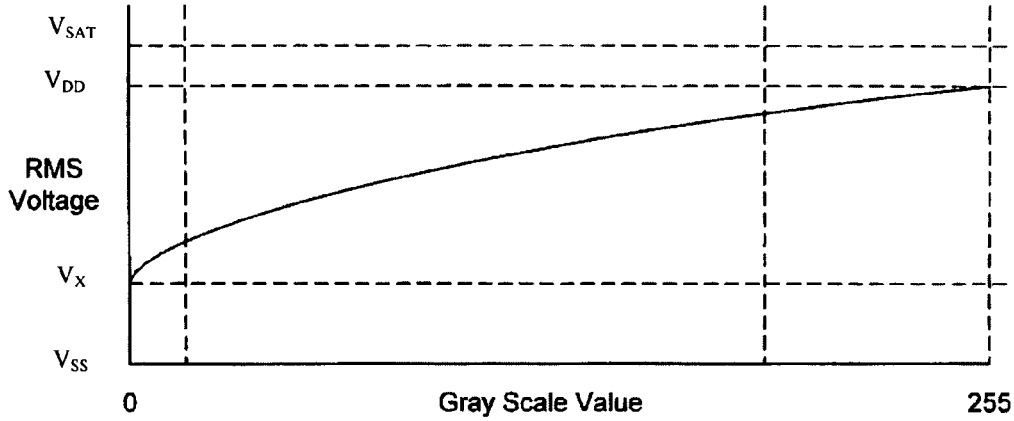
FIG. 12B depicts a liquid crystal device operating between a full "off" state and a less than fully saturated "on state.

To demonstrate the relationship between the semiconductor voltages, liquid crystal drive voltage, and gray scale value, FIG. 12A depicts a likely relationship between the gray scale value and the RMS voltage on the cell. In this instance $V_{DD}$ is equal to the saturation voltage $V_{SAT}$ of the liquid crystal cell. This is achieved by setting $V_X$ and $V_{ITO}$ (not shown) to voltages that achieves this saturation. FIG. 12B depicts a second likely relationship between gray scale voltage and the RMS voltage of the cell in which $V_{DD}$ is less than the saturation voltage of the liquid crystal cell. Again this is achieved by selecting values for $V_X$ and $V_{ITO}$ that establish this lower efficiency setting. This would typically be done to achieve the desired color balance in a three-panel projection system while retaining full gray scale range control over the liquid crystal cell.

In a second embodiment a simplified pixel level DC balance controller is used. In this embodiment the complexity of DC balance control is reduced in several ways. The number of external control signals to the DC balance circuit is reduced from four signals to two as the "break before make" feature is eliminated. The number of transistors required to implement the circuit is reduced from four to two. The full range of voltage authority over the setting of $V_X$ is lost and now $V_X$ can only be adjusted within a reduced voltage range starting approximately one volt above $V_{SS}$.

Figure 13A:
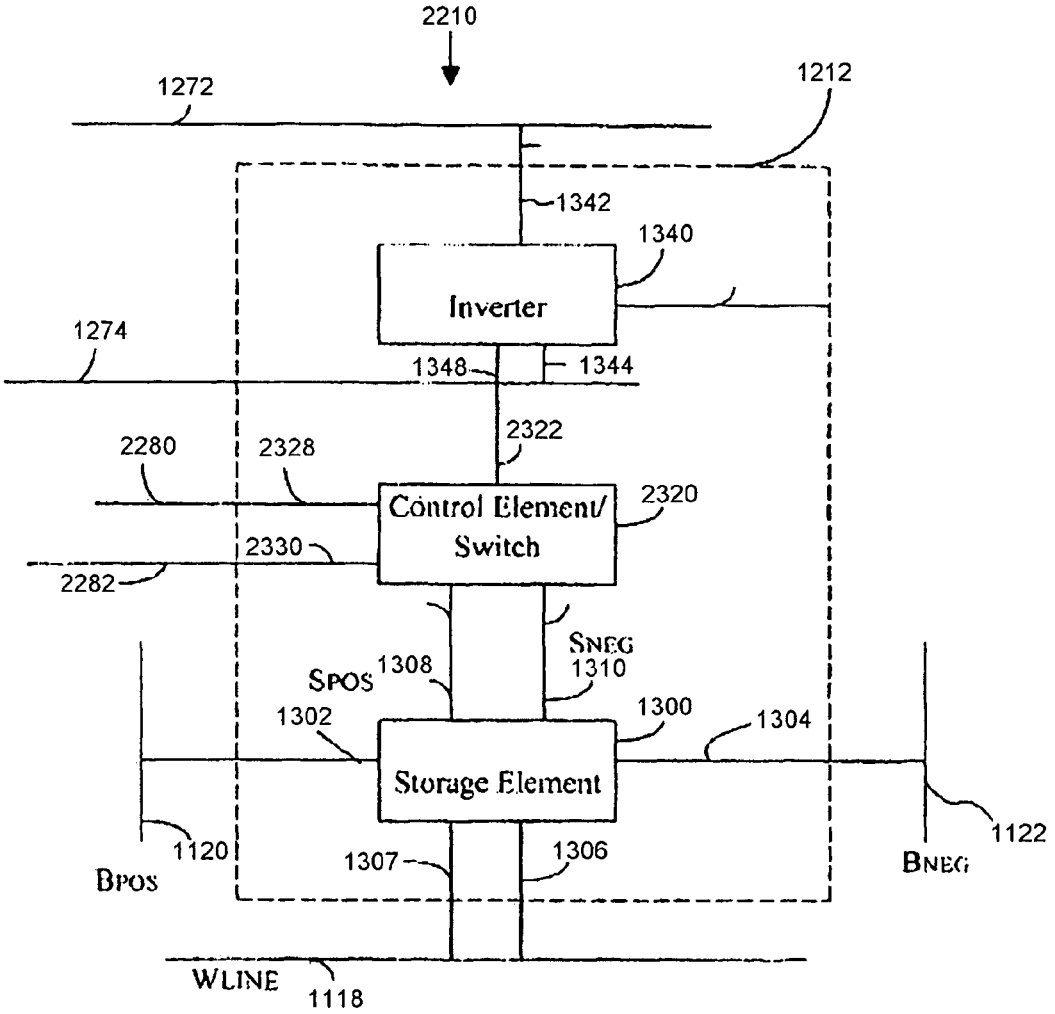
FIG. 13A presents a greatly simplified pixel cell with some limitations to the range of voltages that can be applied.

FIG. 13A presents an overview of the pixel circuit that is analogous to the pixel circuit depicted in FIG. 3A above except for the DC balance circuit. The pixel cell 1210 includes a storage element 1300, a control element or switch 2320, and an inverter 1340. The DC balance control element or switch 2320 is preferably a CMOS based logic device that can selectively pass to another device one of several input voltages. The storage element 1300 includes complementary input terminals 1302 and 1304, respectively coupled to data lines ($B_{POS}$) 1120 and ($B_{NEG}$) 1122. The storage element also includes complementary enable terminals 1306 and 1307 coupled to a word line (WLINE) 1118, and a pair of complementary data output terminals ($S_{POS}$) 1308, and ($S_{NEG}$) 1310.

The DC balance control element or switch 2320 includes a pair of complementary data input terminals 2324 and 2326 which are coupled respectively to the data output terminals ($S_{POS}$) 1308 and ($S_{NEG}$) 1310 of the storage element 1300. The switch 2320 also includes a first voltage supply terminal 2328, and a second voltage supply terminal 2330, which are coupled respectively to the third voltage supply terminal ($V_{SW_P}$) 2280, and the fourth voltage supply terminal ($V_{SW_N}$) 2282 of the voltage control element or switch 2320. The switch 2320 further includes a data output terminal 1322.

The inverter 1340 includes an external connection 1342 to $V_{DD}$ 1272, and a single voltage supply terminal 1344, which is coupled to voltage supply terminal ($V_X$) 1274. The inverter 1340 also includes a data input terminal 1348 coupled to the data output terminal 2322 of the switch 1320, and a pixel voltage output terminal ($V_{PIX}$) 1346 coupled to the pixel mirror 1212. The function of the inverter and voltage application circuit is to insure that the correct voltage among $V_X$ and $V_{DD}$ is delivered to the pixel mirror. It is common practice in semiconductor and circuit board designs for $V_{DD}$ to be brought to the edge of the semiconductor die in multiple instances, especially in dual well and triple well semiconductor technologies. It is also common for different segments of the chip to have different $V_{DD}$ voltage values. These are understood in the context of this invention. It is assumed for the present discussion that the value of $V_{DD}$ is higher than the value that $V_X$ is set to. The DC balance circuit 2320 can interact with inverter 1340 if the setting of $V_X$ is too close to $V_{SS}$ and cause a system malfunction. In practice this has been observed in instances where the setting of $V_X$ is less than a volt above the value of $V_{SS}$.

Figure 13B:
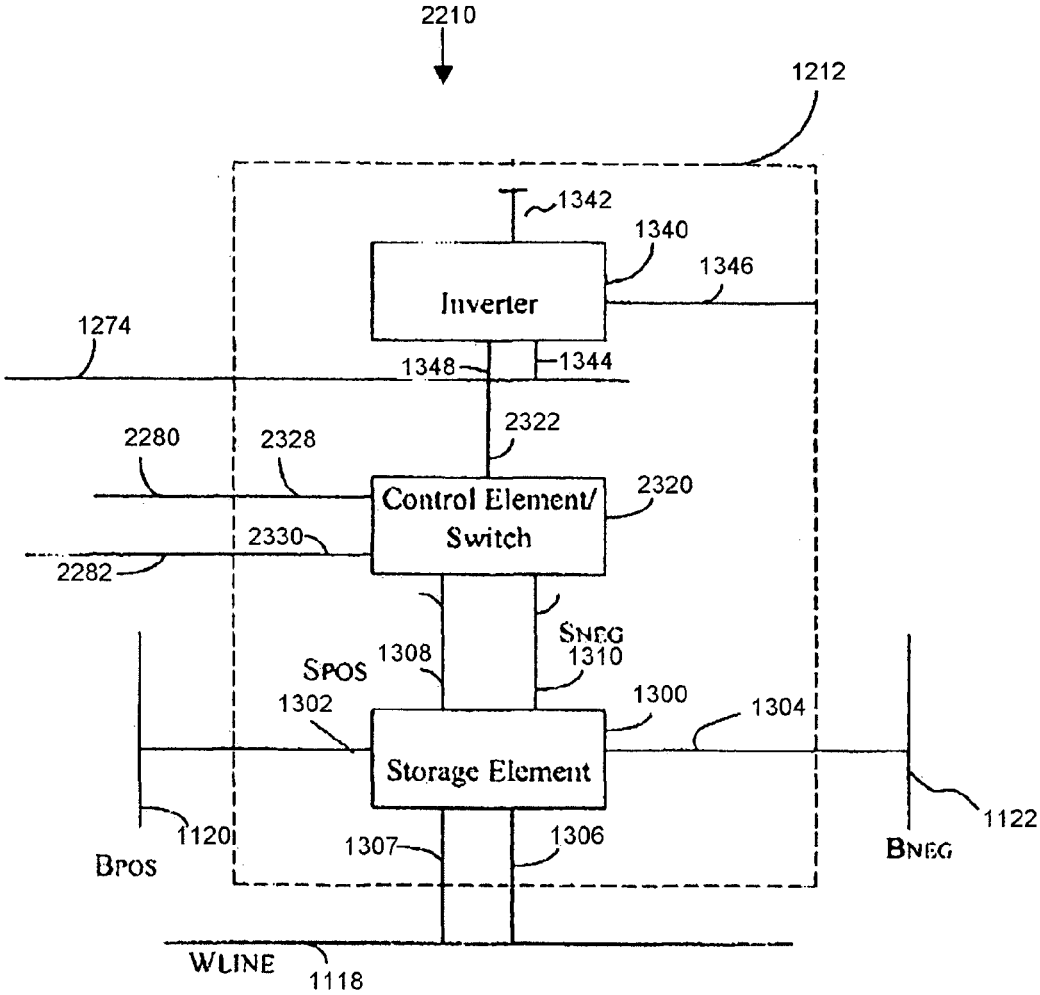
FIG. 13B presents an alternative view of the simplified pixel cell of FIG. 13A.

FIG. 13B presents an alternative structure to that of FIG. 13A. In this alternative the separate line 1272 for $V_{DD}$ is eliminated and the Inverter terminal 1342 is connected directly to a local $V_{DD}$ line (not shown). The pixel circuit components are otherwise identical to the pixel circuit of FIG. 3A so no further explanation is required.

Figure 14:
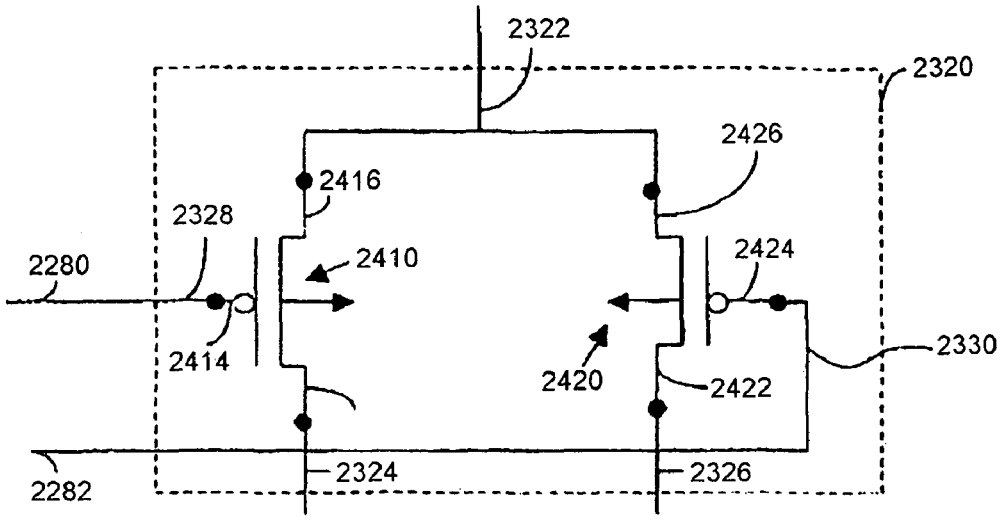
FIG. 14 presents a simplified DC balance controller as implemented in FIGS. 13A and 13B.

FIG. 14 shows a schematic of a preferred embodiment of the switch 2320. The DC balance control switch 2320 includes a first p-channel CMOS transistor 2410 and a second p-channel CMOS transistor 2420. The first transistor 2410 includes a source terminal 2412 coupled to the input terminal 2324, a gate terminal 2414 coupled to the first voltage supply terminal 328, and a drain terminal 2416 coupled to the data output terminal 2322. The second transistor 2420 includes a source terminal 2422 coupled to the input terminal 2326, a gate terminal 2424 coupled to the second voltage supply terminal 2330, and a drain terminal 2426 coupled to the data output terminal 2322.

FIG. 5A shows a drawing of a preferred embodiment of the inverter 1340 implementing the first embodiment presented in FIG. 3A. The inverter 1340 includes a p-channel CMOS transistor 1510 and an n-channel transistor 1520. The p-channel transistor 1510 includes a source terminal 1512 connected to the first voltage supply terminal 1342 which is in turn connected to the $V_{DD}$ supply line 1272, a gate terminal 1514 coupled to the data input terminal 1348, and a drain terminal 1516 coupled to the pixel voltage output terminal ($V_{PIX}$) 1346 which in turn connects to pixel mirror electrode 1212. The n-channel transistor 1520 includes a source terminal 1522 coupled to the second voltage supply terminal 1344 which is in turn connected to the $V_X$ voltage supply line 1274, a gate terminal 1524 coupled to the data input terminal 1348, and a drain terminal 1526 coupled to the pixel voltage output terminal ($V_{PIX}$) 1346.

FIG. 5B shows a schematic of the alternate to the first preferred embodiment of the inverter 1340 implementing the embodiment presented in FIG. 3B. The inverter 1340 includes a p-channel CMOS transistor 1510 and an n-channel transistor 1520. The p-channel transistor 1510 includes a source terminal 1512 connected to the first voltage supply terminal 1342 which is in turn directly connected to a local $V_{DD}$ source (not shown), a gate terminal 1514 coupled to the data input terminal 1348, and a drain terminal 1516 coupled to the pixel voltage output terminal ($V_{PIX}$) 1346. The n-channel transistor 1520 includes a source terminal 1522 coupled to the second voltage supply terminal 1344 which is in turn connected to the $V_X$ supply line 1274, a gate terminal 1524 coupled to the data input terminal 1348, and a drain terminal 1526 coupled to the pixel voltage output terminal ($V_{PIX}$) 1346 which in turn connects to pixel mirror electrode 1212.

FIG. 15 presents one possible configuration of a display after this embodiment. Minor variations similar to the following are envisioned within the scope of this invention. The display system 2200 includes an array of pixel cells 2210, a voltage controller 2220, a processing unit 1240, a memory unit 1230, and a transparent common electrode 2250. The common transparent electrode overlays the entire array of pixel cells 2210. In a preferred embodiment, pixel cells 1210 are formed on a silicon substrate or base material, and are overlaid with an array of pixel mirrors 1212 and each single pixel mirror 1212 corresponding to each of the pixel cells 2210. A substantially uniform layer of liquid crystal material is located in between the array of pixel mirrors 1212 and the transparent common electrode 1250. The transparent common electrode 2250 is preferably formed from a glass substrate coated with a transparent conductive material such as Indium Tin-Oxide (ITO). The memory 1230 is a computer readable medium including programmed data and commands. The memory is capable of directing the processing unit 1240 to implement various voltage modulation and other control schemes. The processing unit 1240 receives data and commands from the memory unit 1230, via a memory bus 1232, provides internal voltage control signals, via voltage control bus 1222, to voltage controller 2220, and provides data control signals (i.e. image data into the pixel array) via data control bus 1234. The voltage controller 1220, the memory unit 1230, and the processing unit 1240 are preferably located on a different portion of the display system than that of the array of pixel cells 2210.

Responsive to control signals received from the processing unit 1240, via the voltage control bus 1222, the voltage controller 2220 provides predetermined voltages to each of the pixel cells 2210 via a first voltage supply terminal ($V_X$) 2274, a second (logic) voltage supply terminal ($V_{SW_P}$) 2280, and a third (logic) voltage supply terminal ($V_{SW_N}$) 2282. The voltage controller 2220 also supplies predetermined voltages $V_{ITO0}$ by volt supply terminal 2236 and $V_{ITO1}$ by voltage supply terminal 2237 to ITO voltage multiplexer unit 2235. Voltage multiplexer unit 2235 selects between $V_{ITO0}$ and $V_{ITO1}$ based on the logic state of ($V_{SW_P}$) 2280 and ($V_{SW_N}$) 2282. The ITO voltage multiplex unit delivers $V_{ITO}$ to the transparent common electrode 2250, via a voltage supply terminal ($V_{ITO}$) 2270. Each of the voltage supply terminals ($V_X$) 1224, ($V_{SW_P}$) 2280, ($V_{SW_N}$) 2282, and ($V_{ITO}$) 2270 are shown in FIG. 15 as being global signals, where the same voltage is supplied to each pixel cell 210 throughout the entire pixel array or to the transparent common electrode 2250 only in the case of $V_{ITO}$ 2270.

As is obvious an alternate embodiment incorporating the layout of FIG. 13B is easily implemented.

The two examples previously provided in FIG. 9A and FIG. 9B illustrate the voltage delivery capabilities of this embodiment. Two examples of the relative voltage variations possible for different states of DC balancing are further described in FIGS. 9A and 9B. In FIG. 9A and FIG. 9B it is to be assumed that the DC Balance State 0 frame and DC Balance State 1 frame present similar absolute values of the voltage differences between the $V_{WHITE}$, $V_{BLACK}$ and $V_{ITO}$ and that the duration of the frames are approximately equal. The values should be as close as possible but may vary slightly and still be sufficient as is well known to those of ordinary skill in the art. In FIG. 9A $V_X$ is set to a point that permits $V_{ITO}$ to exceed the value of ground. This is a common occurrence as is the situation depicted in FIG. 9B, where the lower ITO value is less than the value of $V_{SS}$. Either may occur as a result of different material properties, the wavelength of the light or the voltage handling characteristics of the device semiconductor material.

This embodiment dispenses with the previously described "break before make" circuitry.

The drawings of FIG. 12A and FIG. 12B illustrate the possible optical response characteristics of the display after the second embodiment. FIG. 12A depicts a likely relationship between the gray scale value and the RMS voltage on the cell. In this instance $V_{DD}$ is equal to the saturation voltage $V_{SAT}$ of the liquid crystal cell. This is achieved by setting $V_X$ and $V_{ITO}$ (not shown) to voltages that achieves this saturation. FIG. 12B depicts a second likely relationship between gray scale voltage and the RMS voltage of the cell in which $V_{DD}$ is less than the saturation voltage of the liquid crystal cell. Again this is achieved by selecting values for $V_X$ and $V_{ITO}$ that establish this lower efficiency setting. This would typically be done to achieve the desired color balance in a three-panel projection system while retaining full gray scale range control over the liquid crystal cell.

In a third embodiment the pixel supply voltages are set either to $V_X$ or to $V_{SS}$. Functionally this is equivalent to the first embodiment, again being comprised of the same major building blocks. The inverter in this instance is configured to enable connection of either $V_X$ or $V_{SS}$ to the pixel mirror, depending on the momentary configuration of the combinatory logic element and the SRAM memory of the pixel.

Figure 16A:
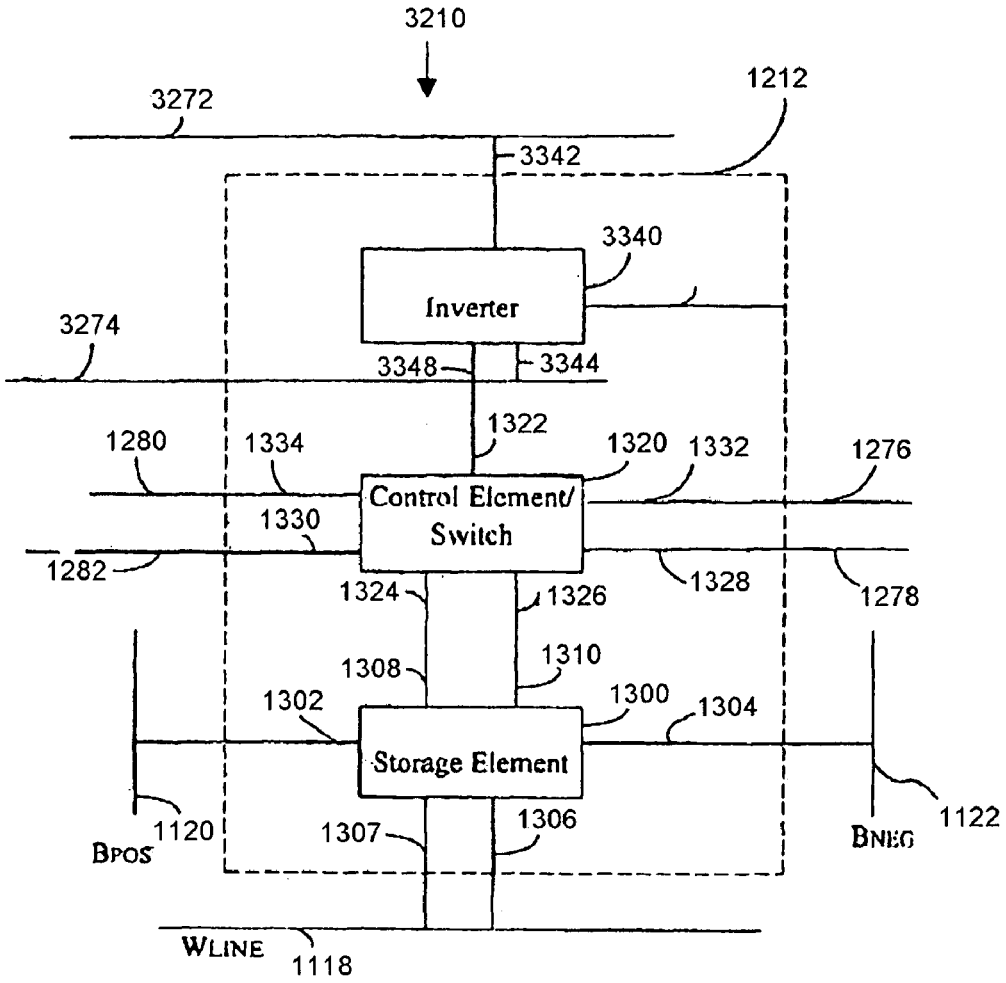
FIG. 16A presents a pixel design wherein one supply voltage is $V_X$ and one pixel supply voltage is $V_{SS}$.

FIG. 16A shows a block diagram of a single pixel cell 3210 of a multi-pixel display in accordance with the present invention. The pixel cell 3210 includes a storage element 1300, a control element or switch 1320, and an inverter 3340. The DC balance control element or switch 1320 is preferably a CMOS based logic device that can selectively pass to another device one of several input voltages. The storage element 1300 includes complementary input terminals 1302 and 1304, respectively coupled to data lines ($B_{POS}$) 1120 and ($B_{NEG}$) 1122. The storage element also includes complementary enable terminals 1306 and 1307 coupled to a word line (WLINE) 1118, and a pair of complementary data output terminals ($S_{POS}$) 1308, and ($S_{NEG}$) 1310.

The DC balance control element or switch 1320 includes a pair of complementary data input terminals 1324 and 1326 which are coupled respectively to the data output terminals ($S_{POS}$) 1308 and ($S_{NEG}$) 1310 of the storage element 1300. The switch 1320 also includes a first voltage supply terminal 1334, and a second voltage supply terminal 1330, which are coupled respectively to the third voltage supply terminal ($V_{SWA_P}$) 1280, and the fourth voltage supply terminal ($V_{SWA_N}$) 1282 of the voltage control element or switch 1320. The switch 1320 further includes a third voltage supply terminal 1332, and a fourth voltage supply terminal 1328, which are coupled respectively to the fifth voltage supply terminal ($V_{SWB_P}$) 1276, and the sixth voltage supply terminal ($V_{SWB_N}$) 1278 of the voltage control element or switch 1320. The switch 1320 further includes a data output terminal 1322.

The inverter 3340 includes an external connection 3344 to $V_{SS}$ 3274, and a single voltage supply terminal 3342, which is coupled to voltage supply terminal ($V_X$) 3272. The inverter 3340 also includes a data input terminal 3348 coupled to the data output terminal 1322 of the DC balance switch 1320, and a pixel voltage output terminal ($V_{PIX}$) 3346 coupled to the pixel mirror 1212. The function of the inverter and voltage application circuit is to insure that the correct voltage among $V_X$ and $V_{SS}$ is delivered to the pixel mirror. $V_{SS}$ is often thought of as device ground although it is possible to have different values within a device for a number of reasons. It is also possible that an entire device may have a bias applied to a common $V_{SS}$ for overall circuit design reasons.

Figure 16B:
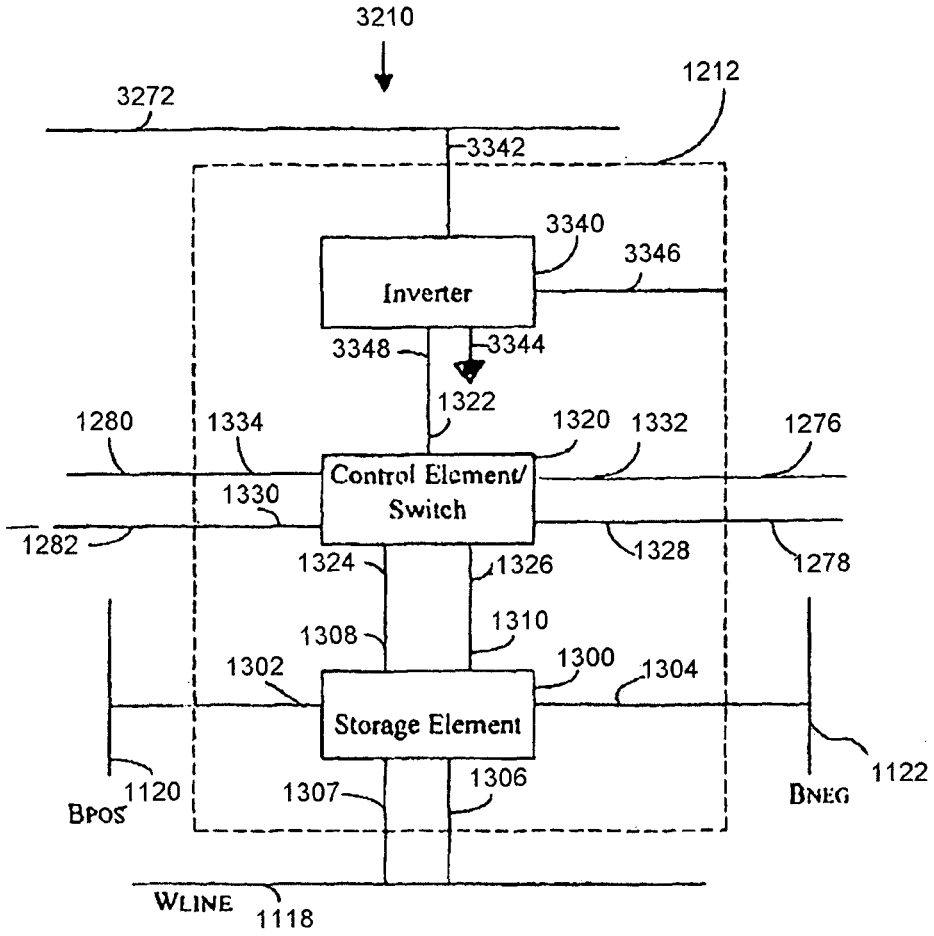
FIG. 16B presents an alternative pixel design to FIG. 16A wherein the connection to $V_{SS}$ is a local connection.

FIG. 16B an alternate view of the third embodiment wherein the connection of the inverter 3340 to $V_{SS}$ is made in the immediate vicinity of the pixel and there is no dedicated $V_{SS}$ 3274 line. The above text for FIG. 16A otherwise completely describes the alternate.

The inverter 3340 includes a connection 3344 to a local $V_{SS}$ line (not shown), and a single voltage supply terminal 3342, which is coupled to voltage supply terminal ($V_X$) 3272. The inverter 3340 also includes a data input terminal 3348 coupled to the data output terminal 1322 of the DC balance switch 1320, and a pixel voltage output terminal ($V_{PIX}$) 3346 coupled to the pixel mirror 1212. The function of the inverter and voltage application circuit is to insure that the correct voltage among $V_X$ and $V_{SS}$ is delivered to the pixel mirror.

Figure 17A:
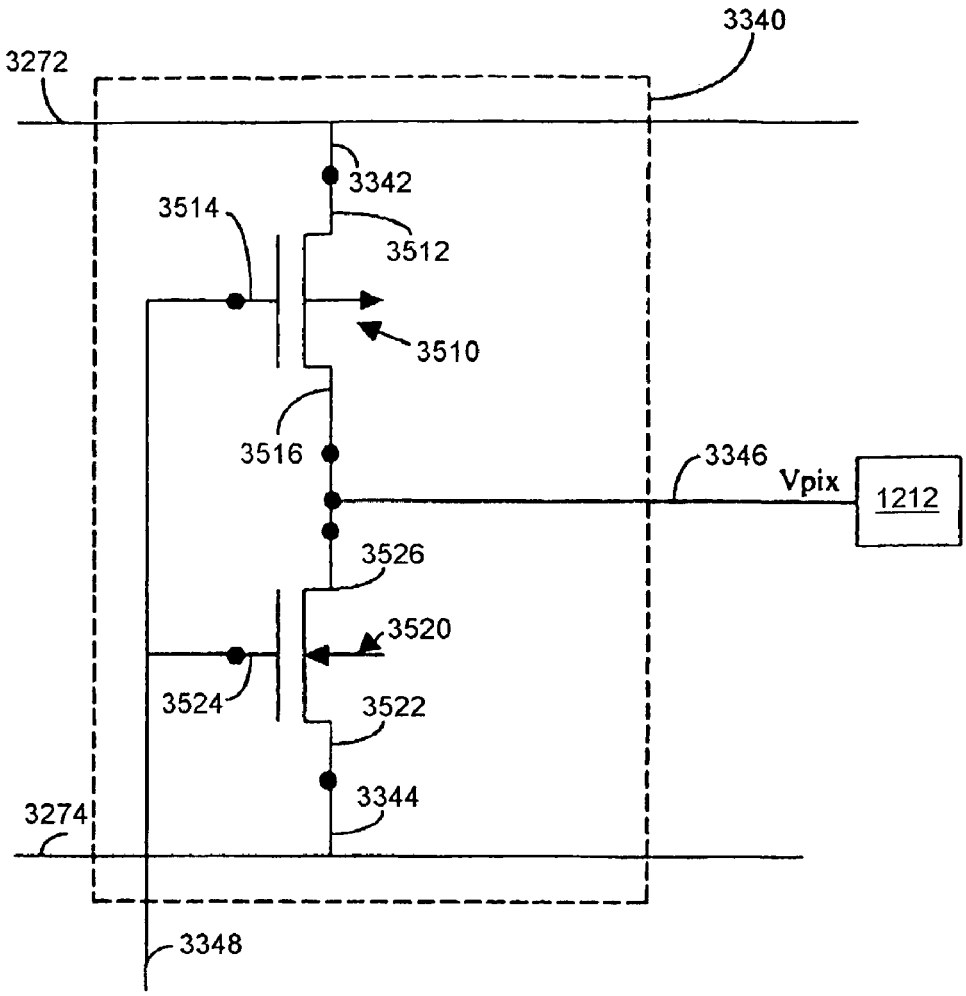
FIG. 17A is an inverter configured to assert either $V_X$ or $V_{SS}$ on a pixel mirror.

FIG. 17A shows a drawing of a preferred embodiment of the inverter 3340 implementing the third embodiment presented in FIG. 16A. The inverter 3340 includes a p-channel CMOS transistor 3510 and an n-channel transistor 3520. The p-channel transistor 3510 includes a source terminal 3512 connected to the first voltage supply terminal 3342 which is in turn connected to the $V_X$ supply line 3272, a gate terminal 3514 coupled to the data input terminal 3348, and a drain terminal 3516 coupled to the pixel voltage output terminal ($V_{PIX}$) 3346 which in turn connects to pixel mirror electrode 1212. The n-channel transistor 3520 includes a source terminal 3522 coupled to the second voltage supply terminal 3344 which is in turn connected to the $V_{SS}$ voltage supply line 3274, a gate terminal 3524 coupled to the data input terminal 3348, and a drain terminal 3526 coupled to the pixel voltage output terminal ($V_{PIX}$) 3346.

Figure 17B:
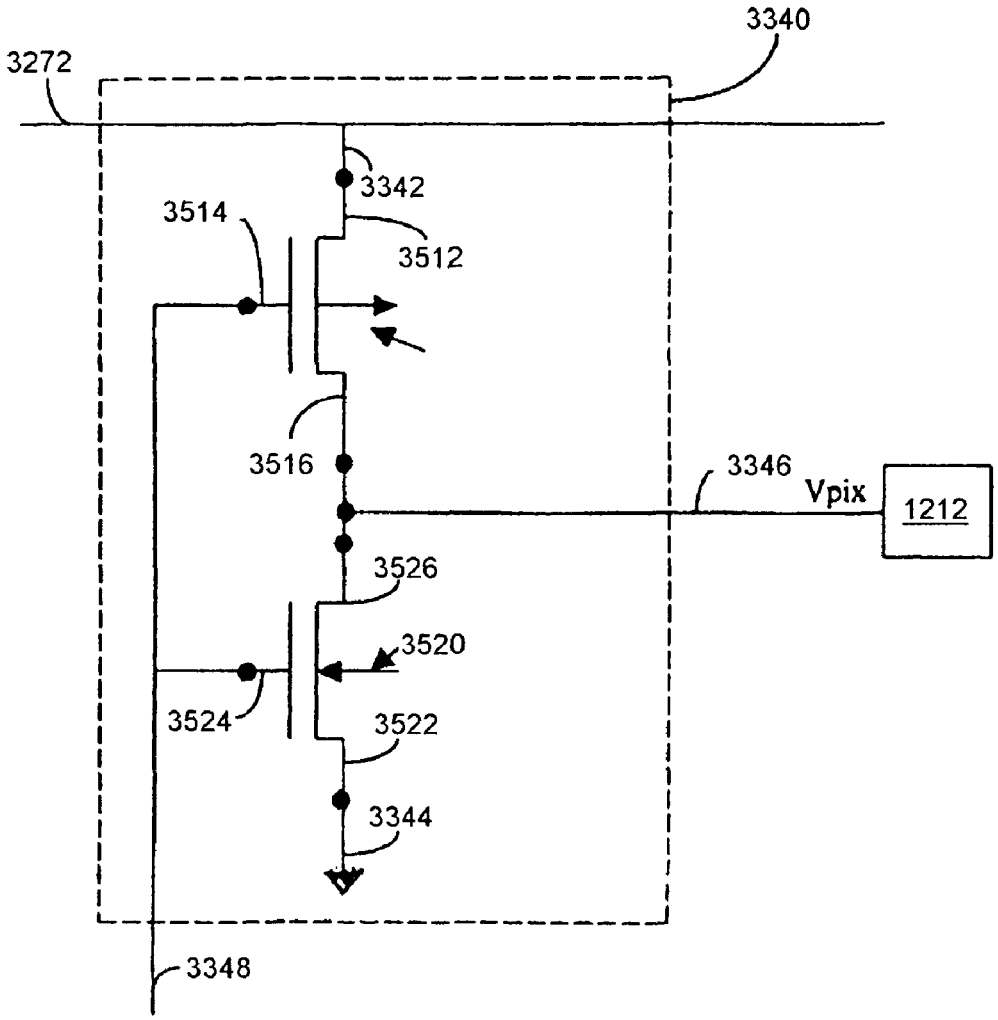
FIG. 17B is an inverter configured after FIG. 17A but wherein the connection to $V_{SS}$ is made local to the pixel circuit.

FIG. 17B presents a drawing of the alternate embodiment of the inverter 3340 implementing the alternate third embodiment presented in FIG. 16B. The inverter 3340 includes a p-channel CMOS transistor 3510 and an n-channel transistor 3520. The p-channel transistor 3510 includes a source terminal 3512 connected to the first voltage supply terminal 3342 which is in turn connected to the $V_X$ supply line 3272, a gate terminal 3514 coupled to the data input terminal 3348, and a drain terminal 3516 coupled to the pixel voltage output terminal ($V_{PIX}$) 3346 which in turn connects to pixel mirror electrode 1212. The n-channel transistor 3520 includes a source terminal 3522 coupled to the second voltage supply terminal 3344 which is in turn connected to a local $V_{SS}$ voltage line (not shown), a gate terminal 3524 coupled to the data input terminal 3348, and a drain terminal 3526 coupled to the pixel voltage output terminal ($V_{PIX}$) 3346.

Figure 18A:
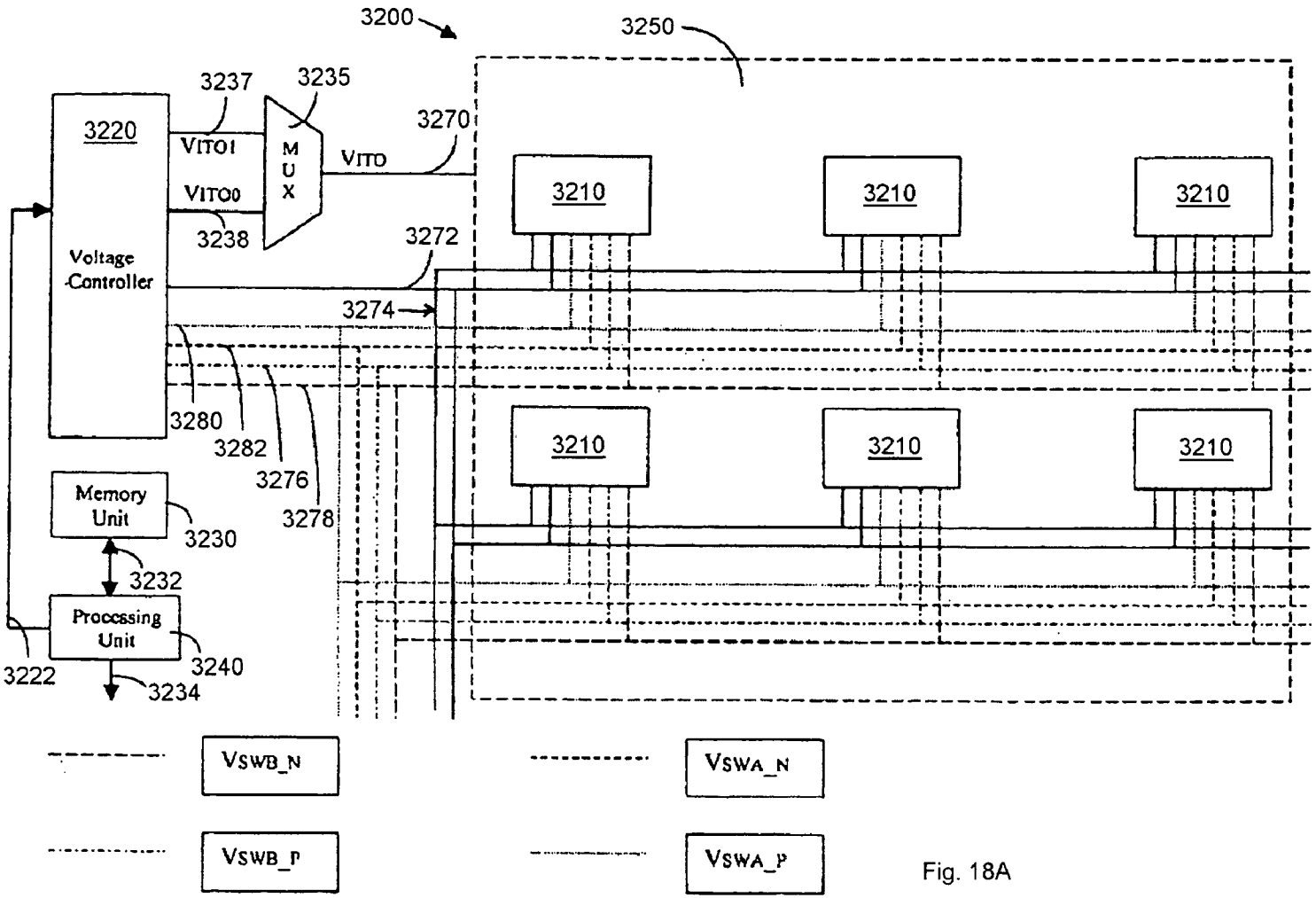
FIG. 18A is a display incorporating pixels of the design presented in FIG. 16A.

FIG. 18A depicts a display implementing the pixel circuit of FIG. 16A. FIG. 18A shows a display system 3200 in accordance with the present invention. The display system 3200 includes an array of pixel cells 3210, a voltage controller 3220, a processing unit 3240, a memory unit 3230, and a transparent common electrode 3250. The common transparent electrode overlays the entire array of pixel cells 3210. In a preferred embodiment, pixel cells 3210 are formed on a silicon substrate or base material, and are overlaid with an array of pixel mirrors 1212 and each single pixel mirror 1212 corresponding to each of the pixel cells 3210. A substantially uniform layer of liquid crystal material is located in between the array of pixel mirrors 1212 and the transparent common electrode 3250. The transparent common electrode 3250 is preferably formed from a glass substrate coated with a transparent conductive material such as Indium Tin-Oxide (ITO). The memory 3230 is a computer readable medium including programmed data and commands. The memory is capable of directing the processing unit 3240 to implement various voltage modulation and other control schemes. The processing unit 3240 receives data and commands from the memory unit 3230, via a memory bus 3232, provides internal voltage control signals, via voltage control bus 1222, to voltage controller 3220, and provides data control signals (i.e. image data into the pixel array) via data control bus 3234. The voltage controller 3220, the memory unit 3230, and the processing unit 3240 are preferably located on a different portion of the display system than that of the array of pixel cells 3210.

Responsive to control signals received from the processing unit 3240, via the voltage control bus 3222, the voltage controller 3220 provides a single predetermined voltage to each of the pixel cells 3210 via a single voltage supply terminal ($V_X$) 3272, a second (logic) voltage supply terminal ($V_{SWB_P}$) 3276, and a third (logic) voltage supply terminal ($V_{SWB_N}$) 3278, a fourth (logic) voltage supply terminal ($V_{SWA_P}$) 3280, and a fifth (logic) voltage supply terminal ($V_{SWA_N}$) 3282. A second voltage is supplied for application to the pixel mirror by direct connection to $V_{SS}$ 3274. The voltage controller 3220 also supplies predetermined voltages $V_{ITO_0}$ by voltage supply terminal 3238 and $V_{ITO_1}$ by voltage supply terminal 3237 to ITO voltage multiplexer unit 3235. Voltage multiplexer unit 3235 selects between $V_{ITO_0}$ and $V_{ITO_0}$ based on the logic state of ($V_{SWB_P}$) 3276, ($V_{SWB_N}$) 3278, ($V_{SWA_P}$) 3280, and ($V_{SWA_N}$) 3282. The ITO voltage multiplex unit delivers $V_{ITO}$ to the transparent common electrode 1250, via a voltage supply terminal ($V_{ITO}$) 3270. Each of the voltage supply terminals ($V_X$) 3272, ($V_{SWB_P}$) 3276, ($V_{SWB_N}$) 3278, ($V_{SWA_P}$) 3280, ($V_{SWA_N}$) 3282, and ($V_{ITO}$) 3270 are shown in FIG. 18A as global signals, where the same voltage is supplied to each pixel cell 3210 throughout the entire pixel array or to the transparent common electrode 3250 only in the case of $V_{ITO}$ 3270. Signal distribution layouts differing from the one depicted in FIG. 18A are well known to those skilled in the art of semiconductor or backplane design and are considered to be encompassed within this design.

Figure 18B:
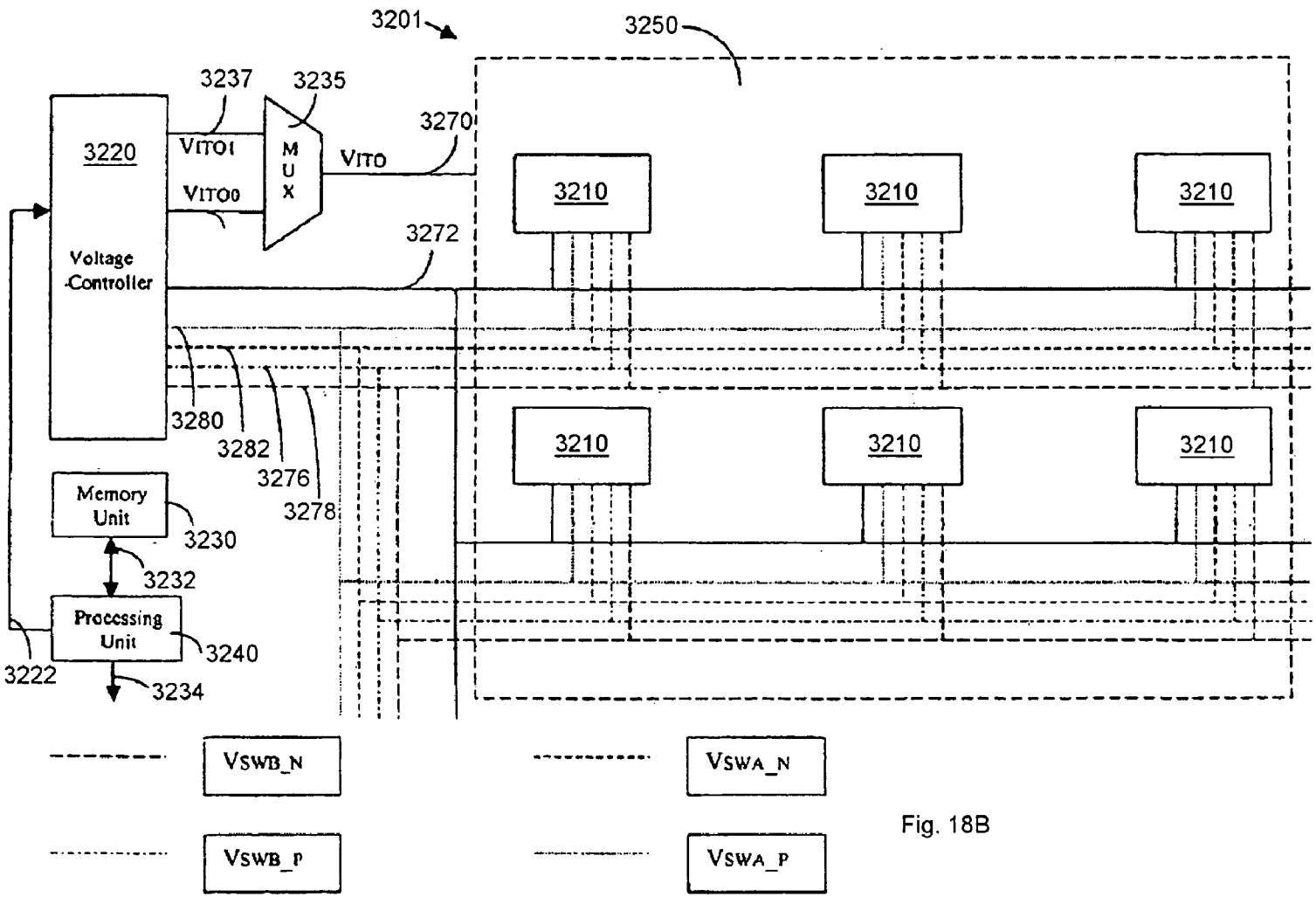
FIG. 18B is a alternate view of a display incorporating pixels of the design presented in FIG. 16B.

FIG. 18B presents the configuration of alternative display 3201 of capability identical to that of display 3200 of FIG. 18A. In FIG. 18B the separate $V_{SS}$ line 3274 is now omitted and the connection of the inverter to $V_{SS}$ is made in the vicinity of the pixel to a $V_{SS}$ line as indicated on FIG. 18B.

Figure 19:
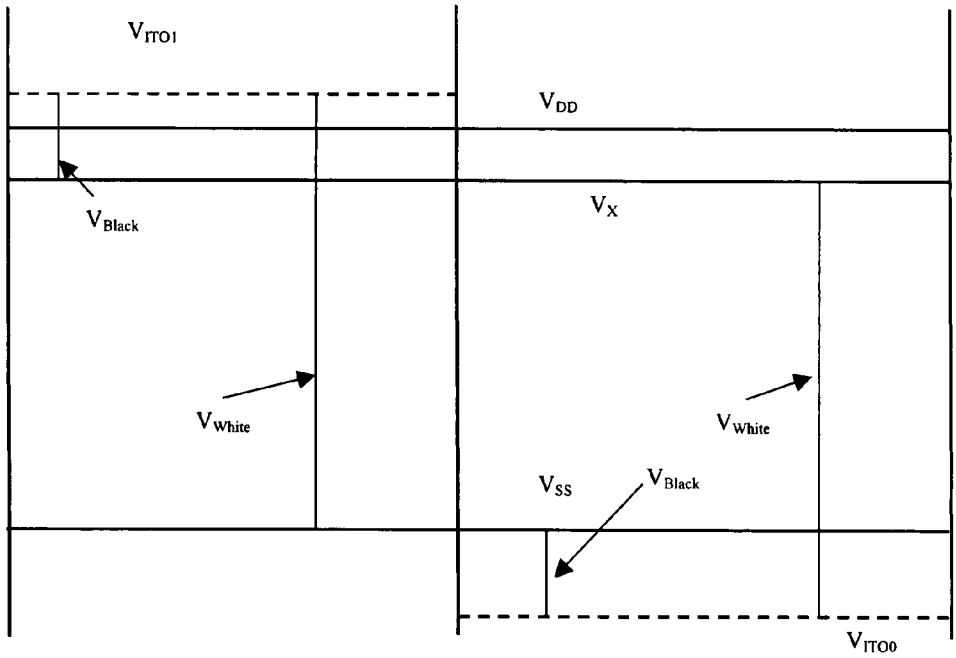
FIG. 19 presents a full cycle of DC balance of a display system after FIG. 18A and FIG. 18B.

FIG. 19 depicts the relative voltages that will occur during a typical full DC balance cycle. The drawings are to an approximate scale only and are intended to represent an ideal DC balance state wherein the duration and magnitude of the voltages for each cycle are identical except as to the field orientation. The field orientation is assumed to be symmetrical. One example of the relative voltages possible for different states of DC balancing is further described in FIG. 19. In FIG. 19 the lower pixel voltage is set to be equal to $V_{SS}$. As a result the lower ITO voltage $V_{ITO0}$ must be less than $V_{SS}$. The position of the upper ITO relative to $V_{DD}$ is determined by the requirements of the liquid crystal cell prescription and the capabilities of the drive electronics. In this example the $V_{ITO1}$ is depicted as greater than $V_{DD}$ but under other circumstances this may not be the case. Either may occur as a result of different material properties, the wavelength of the light or the voltage handling characteristics of the device semiconductor material.

Figure 20:
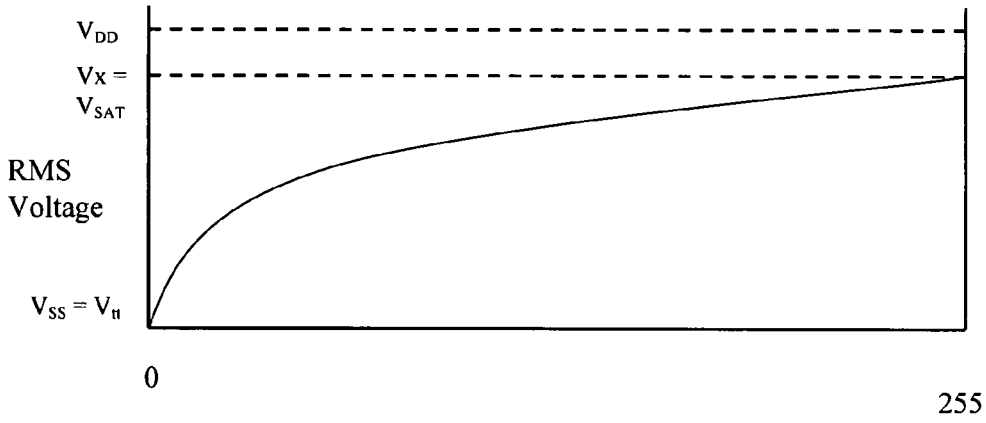
FIG. 20 represents a typical liquid crystal response curve for the third embodiment.

To demonstrate the relationship between the semiconductor voltages, liquid crystal drive voltage, and gray scale value, FIG. 20 depicts a likely relationship between the gray scale value and the RMS voltage on the cell. In this instance $V_X$ is set to the saturation voltage $V_{SAT}$ of the liquid crystal cell. This is achieved by setting $V_X$ and $V_{ITO}$ (not shown) to voltages that achieve this saturation. In other cases, such as color balancing a multi-channel projector it is possible that $V_X$ may be set lower than $V_{SAT}$.

The foregoing describes three embodiments that represent likely implementations of the present invention. Other embodiments not described may fall within the bounds of the described invention.

What is claimed is:

1. A pulse width modulated display system comprising:
- a display controller to deliver voltages, control logic signals and image data to the display system; and
- an array of pixels, of which each pixel comprises the following elements:
  - a SRAM memory cell having two complementary outputs;
  - a DC balance control circuit controlled by a plurality of external control signals;
  - a two-transistor inverter to apply one of two voltages to a pixel mirror;
  - a single voltage source independent of voltage rails of the pixel array of the display system; and
  - a counter electrode disposed opposite the array of pixels and operated at a voltage potential independent of the voltage potential of the pixels,
- wherein the complementary outputs of said SRAM memory cell are both presented to the DC balance control circuit;
- wherein the DC balance control circuit, responsive to the configuration of the external control signals asserts one of the two complementary outputs of the SRAM memory cell to gates of the two transistors of the inverter; and
- wherein the inverter, responsive to the voltage asserted on the gates of its transistors, applies one of two voltages to the pixel mirror for that pixel.

2. The display system of claim 1 wherein the memory cell is a six-transistor SRAM cell.

3. The display system of claim 1 wherein the rail voltage available to the inverter to be applied to the pixel mirror is the upper rail voltage ($V_{DD}$).

4. The display system of claim 3 wherein the independent voltage $V_X$ lies between the upper and lower rail voltages ($V_{DD}$ and $V_{SS}$) of the array of pixels.

5. The display system of claim 1 wherein the rail voltage available to the inverter to be applied to the pixel mirror is the lower rail voltage ($V_{SS}$).

6. The display system of claim 5 wherein the independent voltage $V_X$ lies between the upper and lower rail voltages ($V_{DD}$ and $V_{SS}$).

7. The display system of claim 1 wherein the DC balance control circuit is compatible with operation of the liquid crystal cell over the full extent of the range between the upper and lower rail voltages.

8. The display system of claim 1 wherein the DC balance control circuit is compatible with operation over a portion of the voltage range between the upper rail and the lower rail, being limited by proximity to the voltage of the lower rail.

9. The display system of claim 1 wherein the inverter comprises one p-channel transistor and one n-channel transistor.

10. The display system of claim 7 wherein the DC balance control circuit comprises two pairs of transistors, each pair comprising one p-channel transistor and one n-channel transistor, wherein the gates of each pair are operated by a separate control line according to a "break before make" logic as an XOR gate.

11. The display system of claim 8 wherein the DC balance control circuit comprises two p-channel transistors operating as an XOR gate.

12. The display system of claim 1 wherein the display controller applies one of two voltages to the counter electrode in time synchronization with the operation of the DC balance circuit.

13. The display system of claim 12 wherein the two voltages to be applied to the counter electrode are selected such that the magnitude of the difference between a first voltage to be applied to the counter electrode and a first voltage to be applied to a pixel electrode is substantially equal to the magnitude of the difference between a second voltage to be applied to the counter electrode and a second voltage to be applied to a pixel electrode.

14. The display system of claim 12 wherein the duration of a first DC balance state is substantially equal to the duration of a second DC balance state.

15. The display system of claim 1 wherein different parts of the display circuits have different $V_{DD}$ voltages.

16. The display system of claim 15 wherein $V_{DD}$ of the pixel array differs from $V_{DD}$ of other parts of the display system.

17. The display system of claim 1 wherein $V_{DD}$ of the inverter is provided by a line separate from the $V_{DD}$ supply line of the other components pixel array.

18. The display system of claim 1 wherein $V_{DD}$ of the inverter is provided by a line common to the $V_{DD}$ line of the other components of the pixel circuit.

* * * * *